US008743032B2

(12) United States Patent
Yamashita et al.

(10) Patent No.: US 8,743,032 B2
(45) Date of Patent: Jun. 3, 2014

(54) DISPLAY APPARATUS, DRIVING METHOD FOR DISPLAY APPARATUS AND ELECTRONIC APPARATUS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 1349 days.

(21) Appl. No.: 12/232,706

(22) Filed: Sep. 23, 2008

(65) Prior Publication Data

US 2009/0109208 A1 Apr. 30, 2009

(30) Foreign Application Priority Data

Oct. 26, 2007 (JP) ..... 2007-278291

(51) Int. Cl.
*G09G 3/32* (2006.01)
*G09G 3/30* (2006.01)

(52) U.S. Cl.
USPC ..... 345/82; 345/76

(58) Field of Classification Search
USPC ..... 345/76–83
See application file for complete search history.

(56) References Cited

U.S. PATENT DOCUMENTS

| | | | | |
|---|---|---|---|---|
| 6,421,033 | B1 | 7/2002 | Williams et al. | |
| 7,659,872 | B2 | 2/2010 | Yamashita et al. | |
| 8,044,895 | B2 * | 10/2011 | Miyake et al. | 345/77 |
| 8,242,980 | B2 * | 8/2012 | Choi et al. | 345/76 |
| 2006/0001618 | A1 * | 1/2006 | Shin | 345/76 |
| 2008/0088549 | A1 * | 4/2008 | Nathan et al. | 345/80 |

FOREIGN PATENT DOCUMENTS

| | | | |
|---|---|---|---|
| JP | 60-198579 | A | 10/1985 |
| JP | 02-118593 | A | 5/1990 |
| JP | 09-138659 | A | 5/1997 |
| JP | 2003-510661 | | 3/2003 |
| JP | 2003-122306 | A | 4/2003 |
| JP | 2003-255897 | A | 9/2003 |
| JP | 2005-338766 | A | 12/2005 |
| JP | 2006-133542 | | 5/2006 |
| JP | 2007-102046 | A | 4/2007 |

OTHER PUBLICATIONS

Japanese Office Action issued Oct. 20, 2009 for corresponding Japanese Application No. 2007-278291.
Japanese Office Action issued May 11, 2010 for corresponding Japanese Application No. 2009-284942.

* cited by examiner

*Primary Examiner* — Jonathan Horner
(74) *Attorney, Agent, or Firm* — Rader, Fishman & Grauer PLLC

(57) ABSTRACT

Disclosed here in is a display apparatus, including, a pixel array section including a plurality of pixels arrayed in rows and columns and each including an electro-optical device, a pixel circuit provided commonly to each plural ones of the pixels in the same pixel row in the pixel array section and including a writing transistor for writing an image signal, a holding capacitor for holding the image signal written by the writing transistor and a driving transistor for driving the electro-optical devices of the plural pixels, and a plurality of scanning circuits configured to time-divisionally and selectively place the electro-optical devices included in the pixels into a forwardly biased state.

14 Claims, 16 Drawing Sheets t= PRIOR TO t1 t=t1 t=t2 t=t3 t=t4 t=t5 t=t6 t=t7

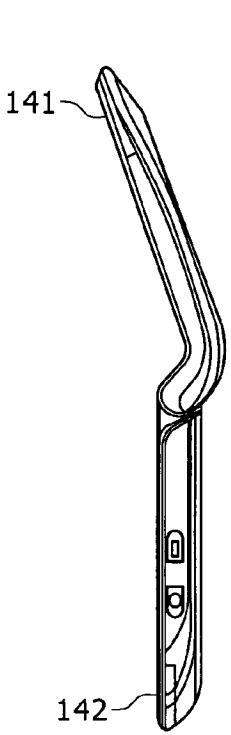
FIG.19A FIG.19B
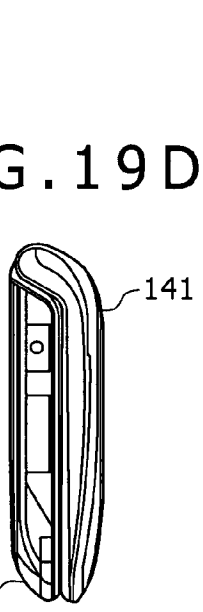
FIG.19D
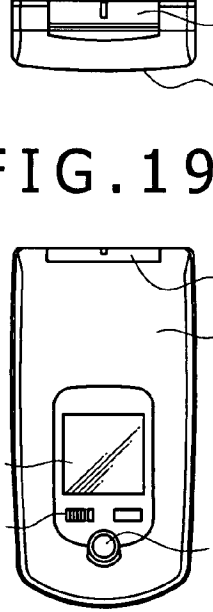
FIG.19C
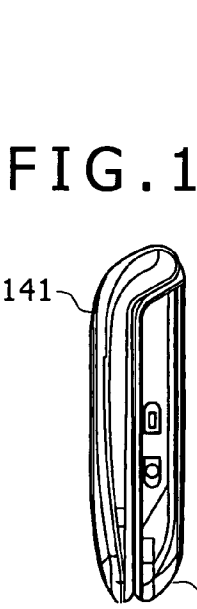
FIG.19E
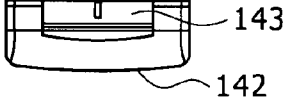
FIG.19F
FIG.19G

DISPLAY APPARATUS, DRIVING METHOD FOR DISPLAY APPARATUS AND ELECTRONIC APPARATUS

CROSS REFERENCES TO RELATED APPLICATIONS

The present invention contains subject matter related to Japanese Patent Application JP 2007-278291 filed in the Japan Patent Office on Oct. 26, 2007, the entire contents of which being incorporated herein by reference.

BACKGROUND OF THE INVENTION

1. Field of the Invention

This invention relates to a display apparatus, a driving method for a display apparatus and an electronic apparatus, and more particularly to a display apparatus of the flat type or flat panel type wherein a plurality of pixels including electro-optical devices are disposed in rows and columns, that is, in a matrix, and a driving method for the display apparatus and an electronic apparatus including the display apparatus.

2. Description of the Related Art

In recent years, in the field of display apparatus for displaying an image, flat type display apparatus wherein pixels or pixel circuits including light emitting devices are disposed in a matrix have been popularized rapidly. As a flat type display apparatus, a display apparatus which uses an electro-optical device of the current driven type whose emission light luminance varies in response to the value of current flowing through the device, for example, an organic EL (Electro Luminescence) display apparatus which uses an organic EL device which utilizes a phenomenon that an organic thin film emits light when an electric field is applied thereto, has been developed and commercialized.

The organic EL display apparatus has the following characteristics. In particular, it exhibits low power consumption because the organic EL device can be driven by an application voltage lower than 10 V. Further, since the organic EL device is a selfluminous device, the organic display apparatus displays an image of high visual observability in comparison with a liquid crystal display apparatus wherein the intensity of light from a light source or backlight is controlled by the liquid crystal cell for each pixel including a liquid crystal cell. Besides, since the organic EL display apparatus does not require an illumination member such as a backlight which is essentially required by a liquid crystal display apparatus, it is easy to reduce the weight and the thickness thereof. Further, since the response speed of the organic EL device is approximately several μsec and very high, an afterimage upon dynamic image display does not appear.

The organic EL display apparatus can adopt a simple or passive matrix method and an active matrix method as a driving method therefor similarly as in the liquid crystal display apparatus. However, although the display apparatus of the passive matrix type is simple in structure, it has such a problem that, since the light emission period of the electro-optical devices decreases as the number of scanning lines or the number of pixels increases, it is difficult to implement a display apparatus of a large size and of high definition.

Therefore, in recent years, a display apparatus of the active matrix type has been and is being developed energetically wherein the current flowing to an electro-optical device is controlled by an active device provided in the same pixel circuit as the electro-optical device such as, for example, an insulating gate type field effect transistor, usually a thin film transistor (TFT). A display apparatus of the active matrix type can be easily formed as a display apparatus of a large size and high definition because the electro-optical device continues to emit light for a period of one frame.

Incidentally, it is generally known that the I-V characteristic, that is, the current-voltage characteristic, of an organic EL device deteriorates as time passes, that is, exhibits time degradation. In a pixel circuit which uses a TFT of the N-channel type as a transistor for current-driving an organic EL device (such a transistor is hereinafter referred to as driving transistor), since the organic EL device is connected to the source side of the driving transistor, if the I-V characteristic of the organic EL device suffers from time degradation, then the gate-source voltage Vgs of the driving transistor varies. As a result, also the emission light luminance of the organic EL device varies.

This is described more particularly. The source potential of the driving transistor depends upon the working point of the driving transistor and the organic EL device. Then, if the I-V characteristic of the organic EL device deteriorates, then since the working point of the driving transistor and the organic EL device varies, even if the same voltage is applied to the gate of the driving transistor, the source potential of the driving transistor varies. Consequently, the gate-source voltage Vgs of the driving transistor varies, and the value of current flowing through the driving transistor varies. As a result, also the value of current flowing through the organic EL device varies, and this varies the emission light luminance of the organic EL device.

Meanwhile, a pixel circuit which uses a polycrystalline silicon TFT suffers not only from time degradation of the I-V characteristic of the organic EL device but also from secular change of the threshold voltage Vth of the driving transistor or the mobility of a semiconductor thin film which composes a channel of the driving transistor (such mobility is hereinafter referred to as mobility μ of the driving transistor). Further, with the pixel circuit, the threshold voltage Vth or the mobility μ differs for each pixel from a dispersion in the fabrication process. In other words, each transistor has a dispersion in characteristics.

Where the threshold voltage Vth or the mobility μ of the driving transistor differs for each pixel, also the value of current flowing to the driving current disperses for each pixel. Therefore, even if the same voltage is applied to the gate of the driving transistors of the pixels, a dispersion in the emission light luminance of the organic EL device appears between the pixels. As a result, uniformity of the screen image is damaged.

Therefore, in order to keep the emission light luminance of the organic EL device fixed without being influenced, even if the I-V characteristic of the organic EL device suffers from time degradation or the threshold voltage Vth or the mobility μ of the driving transistor suffers from secular change, by such time degradation or secular change, the following configuration is adopted. In particular, each pixel circuit is provided with a compensation function for the characteristic variation of the organic EL device or a correction function for correction against the variation of the threshold voltage of the driving transistor (such correction is hereinafter referred to as threshold value correction) or for correction against the variation of the mobility μ of the driving transistor (such correction is hereinafter referred to as mobility correction). The configuration just described is disclosed, for example, in Japanese Patent Laid-Open No. 2006-133542.

By providing each pixel circuit with a compensation function for the characteristic variation of the organic EL device and correction functions against the threshold voltage Vth and the mobility μ of the driving transistor in this manner, even if the I-V characteristic of the organic EL device suffers from time degradation of the threshold voltage Vth or the mobility μ of the driving transistor suffers from secular change, the emission light luminance of the organic EL device can be kept fixed without being influenced by such time degradation or secular change as described above.

SUMMARY OF THE INVENTION

In the various kinds of correction, particularly in the mobility correction, where the signal voltage of an image signal to be written into a pixel is represented by Vsig and the capacitance value of the pixel capacitor, that is, the capacitor in the pixel, is represented by C, the optimum correction time t for the mobility correction is given by an expression of $t=C/(k\mu Vsig)$ and depends upon the capacitance value C of the pixel capacitor. In the expression above, k is a constant. Further, the capacitance C of the pixel capacitor is a composition of the capacitance values of the holding capacitor for holding the signal voltage Vsig and the capacitance component of the organic EL device (such capacitance component is hereinafter referred to as EL capacitor). It is to be noted that, as occasion demands, a sub capacitor for supplementing shortage of the capacitance of the EL capacitor is provided. In this instance, also the capacitance value of the sub capacitor is included in the capacitance value C of the pixel capacitor.

Incidentally, as enhancement of the definition of a display apparatus proceeds and reduction of the pixel size proceeds together with this, it becomes difficult to sufficiently assure the area for the holding capacitor and the sub capacitor when such capacitors are formed in one pixel or sub pixel. That a sufficient area cannot be assured for the holding capacitor or the sub capacitor signifies that it cannot be avoided for the capacitors to have a comparatively low capacitance value. Then, if the capacitance value of the holding capacitor or the sub capacitor is not sufficiently high, then a sufficient long period of time cannot be assured as mobility correction time which depends upon the capacitance value.

Therefore, it is desirable to provide a display apparatus which can assure a sufficiently long period of time as correction time, particularly as correction time for mobility correction even if reduction of the pixel size proceeds together with refinement of the display apparatus, and a driving method suitable for the display apparatus and an electronic apparatus which uses the display apparatus.

According to an embodiment of the present invention there is provided a display apparatus, including:

a pixel array section including a plurality of pixels arrayed in rows and columns and each including an electro-optical device;

a pixel circuit provided commonly to each plural ones of the pixels in the same pixel row in the pixel array section and including a writing transistor for writing an image signal, a holding capacitor for holding the image signal written by the writing transistor and a driving transistor for driving the electro-optical devices of the plural pixels; and a plurality of scanning circuits configured to time-divisionally and selectively place the electro-optical devices included in the pixels into a forwardly biased state.

According to another embodiment of the present invention there is provided a driving method for a display apparatus which includes a pixel array section including a plurality of pixels arrayed in rows and columns and each including an electro-optical device, including the steps of:

providing a pixel circuit commonly to each plural ones of the pixels in the same pixel row in the pixel array section, the pixel circuit including a writing transistor for writing an image signal, a holding capacitor for holding the image signal written by the writing transistor and a driving transistor for driving the electro-optical devices of the plural pixels; and selectively placing the electro-optical devices included in the pixels into a forwardly biased state to time-divisionally drive the electro-optical devices by means of the pixel circuits.

According to yet another embodiment of the present invention there is provided a An electronic apparatus, including:

a display apparatus including a pixel array section including a plurality of pixels arrayed in rows and columns and each including an electro-optical device, a pixel circuit provided commonly to each plural ones of the pixels in the same pixel row in the pixel array section and including a writing transistor for writing an image signal, a holding capacitor for holding the image signal written by the writing transistor and a driving transistor for driving the electro-optical devices of the plural pixels, and a plurality of scanning circuits configured to time-divisionally and selectively place the electro-optical devices included in the pixels into a forwardly biased state.

In the display apparatus and an electronic apparatus which includes the display apparatus, a plurality of pixels in the same pixel row of the pixel array section, for example, two pixels, are determined as a unit, and the pixel circuit for one pixel other than the organic EL device is provided commonly to the two pixels of the unit. Consequently, the layout area for the holding capacitor can be increased to twice or more in comparison with that in an alternative case wherein a pixel circuit is disposed for each pixel. Therefore, the capacitance value of the holding capacitor can be increased to twice or more. The correction periods for threshold value correction and mobility correction, particularly the optimum correction time period for mobility correction, depends upon the capacitance value of the holding capacitor. Accordingly, even if refinement of pixels advances together with enhancement of the definition of the display apparatus, since the capacitance value of the holding capacitor can be increased, a sufficient period of time can be assured as the optimum correction time for mobility correction.

With the display apparatus and the electronic apparatus, since a sufficient period of time can be assured for the periods of time for each value correction and mobility correction, particularly for the optimum correction time for mobility correction, can be assured, mobility correction operation can be carried out with certainty. As a result, enhancement of the picture quality of the display screen image can be achieved.

BRIEF DESCRIPTION OF THE DRAWINGS

FIGS. 19A and 19B are a front elevational view and a side elevational view, respectively, showing appearances of a portable telephone set, to which the embodiments of the present invention is applied, in an unfolded state and FIGS. 19C to 19G are a front elevational view, a left side elevational view, a right side elevational view, a top plan view and a bottom plan view, respectively, of the portable telephone set in a folded state.

DETAILED DESCRIPTION OF THE PREFERRED EMBODIMENTS

Reference Example

First, in order to facilitate understandings of the present invention, an active matrix type display apparatus on which the present invention is based is described as a reference example. The active matrix type display apparatus according to the reference example is disclosed in Japanese Patent Application No. 2006-141836 filed for patent by the assignee of the present invention.

Figure 1:
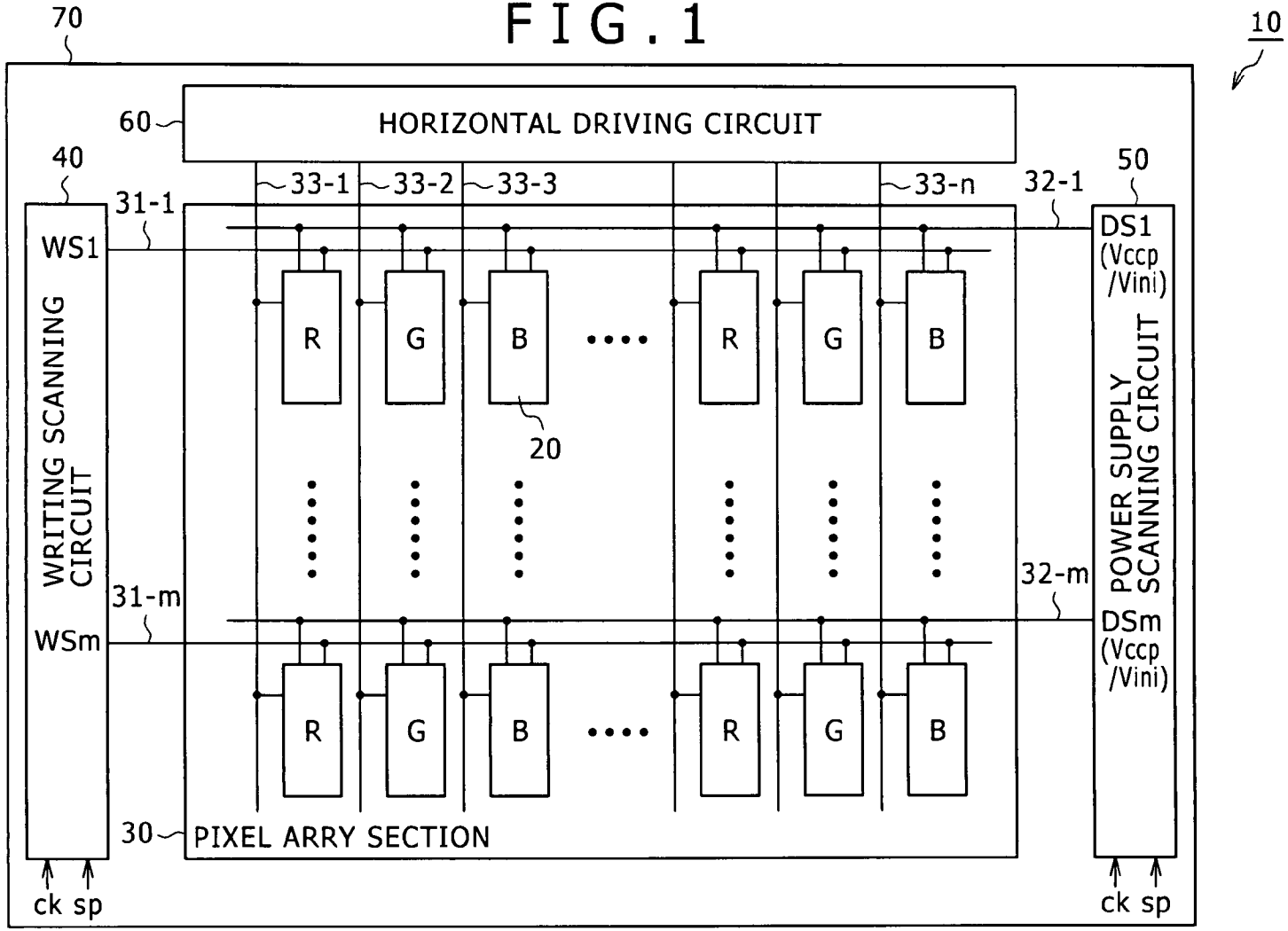
FIG. 1 is a system diagram showing a general configuration of an organic EL display apparatus according to a reference example.

FIG. 1 schematically shows a basic configuration of the active matrix type display apparatus according to the reference example. Here, the active matrix type display apparatus uses, as a light emitting device for a pixel or pixel circuit, an electro-optical device of the current driven type whose emission light luminance varies in response to the value of current flowing therethrough. Thus, it is assumed that the active matrix type display apparatus described below is an active matrix type organic EL display apparatus which uses an organic EL device, that is, an organic electroluminescence device as a light emitting device of a pixel or pixel circuit.

Referring to FIG. 1, the organic EL display apparatus 10 according to the reference example includes a pixel array section 30 wherein a plurality of sub pixels 20 are disposed two-dimensionally in rows and columns, that is, in a matrix such that each three ones thereof for red (R), green (G) and blue (B) form one pixel. However, in the following description, a sub pixel is referred to as a pixel for the convenience of description. The organic EL display apparatus 10 further includes driving sections disposed around the pixel array section 30 for driving the pixels 20. The driving sections for driving the pixels 20 include, for example, a writing scanning circuit 40, a power supply scanning circuit 50, and a horizontal driving circuit 60.

The pixel array section 30 includes scanning lines 31-1 to **31-*m* and power supply lines 32-1 to 32-*m* wired for the individual pixel rows and signal lines 33-1 to 33-*n*** wired for the individual pixel columns in the pixel array of the m rows and the n columns.

The pixel array section 30 is normally formed on a transparent insulating substrate such as a glass substrate and has a flat panel structure. Each of the pixels 20 of the pixel array section 30 can be formed using an amorphous silicon TFT (Thin Film Transistor) or a low-temperature polycrystalline silicon TFT. Where a low-temperature polycrystalline silicon TFT is used, also the writing scanning circuit 40, power supply scanning circuit 50 and horizontal driving circuit 60 can be mounted on a display panel or substrate 70 which forms the pixel array section 30.

The writing scanning circuit 40 is formed from a shift register which shifts or transfers a start pulse sp successively in synchronism with a clock pulse ck or from a like element. Upon writing of an image signal into the pixels 20 of the pixel array section 30, writing pulses or scanning signals WS1 to WSm are successively supplied to the scanning lines 31-1 to **31-*m* to scan the pixels 20 of the pixel array section 30** in order in a unit of a row (line sequential scanning).

The power supply scanning circuit 50 is formed from a shift register which successively shifts the start pulse sp in synchronism with the clock pulse ck or from a like element. The power supply scanning circuit 50 supplies power supply line potential DS1 to DSm, which are changed over by a first potential Vccp and a second potential Vini which is lower than the first potential Vccp, to the power supply lines 32-1 to **32-*m*, respectively, in synchronism with the line sequential scanning by the writing scanning circuit 40 to control the pixels 20** between a light emitting state and a no-light emitting state.

The horizontal driving circuit 60 suitably selects one of a signal voltage Vsig of an image signal, which corresponds to luminance information supplied thereto from a signal supplying source not shown, and an offset voltage Vofs, and writes the selected voltage into the pixels 20 of the pixel array section 30, for example, in a unit of a row, through the signal lines 33-1 to **33-*n*. In other words, the horizontal driving circuit 60** uses a line sequential writing driving form wherein the signal voltage Vsig of the image signal written in a unit of a row or line.

The offset voltage Vofs is a reference voltage for the signal voltage Vsig of the image signal, that is, a voltage corresponding to the black level. Meanwhile, the second potential Vini is set to a potential lower than the offset voltage Vofs, for example, a potential lower then Vofs−Vth where Vth is a threshold voltage of a driving transistor 22, preferably a potential sufficiently lower than Vofs−Vth.

(Pixel Circuit)

Figure 2:
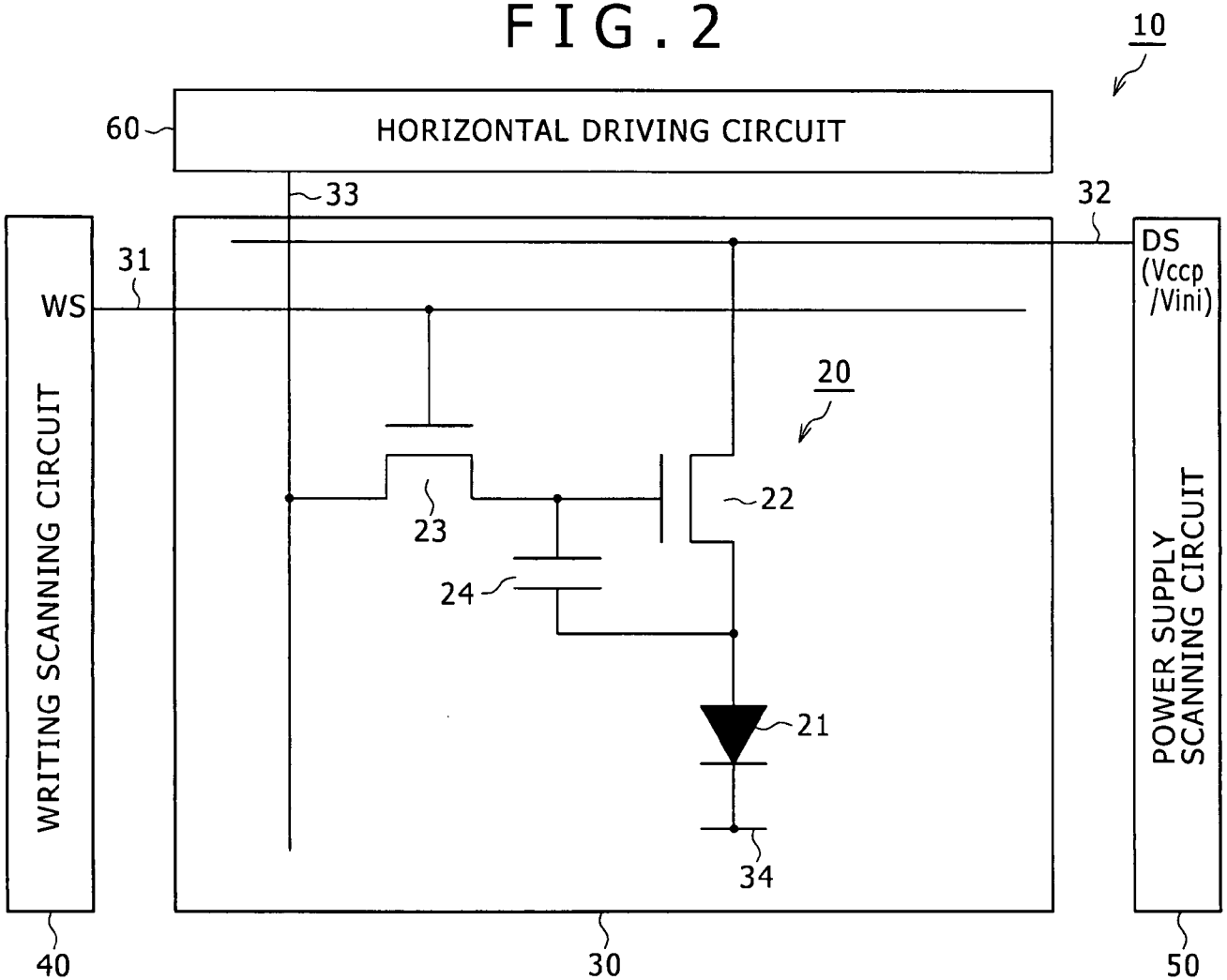
FIG. 2 is a circuit diagram showing a particular example of a pixel or pixel circuit of the organic EL display apparatus of FIG. 1.

FIG. 2 shows an example of a particular configuration of the pixels 20 in the organic EL display apparatus 10 of the reference example.

Referring to FIG. 2, each pixel 20 includes an electro-optical device of the current driven type whose emission light luminance varies in response to the value of current flowing therethrough, for example, an organic EL device 21, as a light emitting device. The pixel 20 further includes a driving transistor 22, a writing transistor 23 and a holding capacitor 24.

Here, an N-channel type TFT is used for the driving transistor 22 and the writing transistor 23. However, the combination of the conduction types of the driving transistor 22 and the writing transistor 23 is a mere example, and a different combination of conduction types may be adopted.

The organic EL device 21 is connected at the cathode electrode thereof to a common power supply line 34 which is wired commonly to all of the pixels 20. The driving transistor 22 is connected at the source electrode thereof to the anode electrode of the organic EL device 21 and at the drain electrode thereof to a power supply line 32 which is one of the power supply lines 32-1 to **32-*m***.

The writing transistor 23 is connected at the gate electrode thereof to a scanning line 31 which is one of the scanning lines 31-1 to **31-*m* and at one of the source and drain electrodes to a signal line 33 which is one of the signal lines 33-1 to 33-*n*. The writing transistor 23 is connected at the other one of the source and drain electrodes thereof to the gate electrode of the driving transistor 22**.

The holding capacitor 24 is connected at one of the electrodes thereof to the gate electrode of the driving transistor 22 and at the other electrode thereof to the source electrode of the driving transistor 22 and the anode electrode of the organic EL device 21. It is to be noted that an auxiliary capacitor may be connected between the anode electrode of the organic EL device 21 and a fixed potential to supplement for shortage of the EL capacitance of the organic EL device 21.

In the pixel 20 having the configuration described above, the writing transistor 23 is placed into a conducting state in response to a scanning line potential WS applied to the gate electrode thereof from the writing scanning circuit 40 through the scanning line 31. Consequently, the signal voltage Vsig of the image signal corresponding to luminance information or the offset voltage Vofs supplied from the horizontal driving circuit 60 through the signal line 33 is sampled and written into the pixel 20.

The signal voltage Vsig or the offset voltage Vofs written in the pixel 20 is applied to the gate electrode of the driving transistor 22 and retained into the holding capacitor 24. The driving transistor 22 receives supply of current from the power supply line 32 when the potential DS of the power supply line 32 (32-1 to **32-*m*) is the first potential Vccp to supply driving current of a current value corresponding to the voltage value of the signal voltage Vsig held in the holding capacitor 24 to the organic EL device 21 to current-drive the organic EL device 21** to emit light.

(Pixel Structure)

Figure 3:
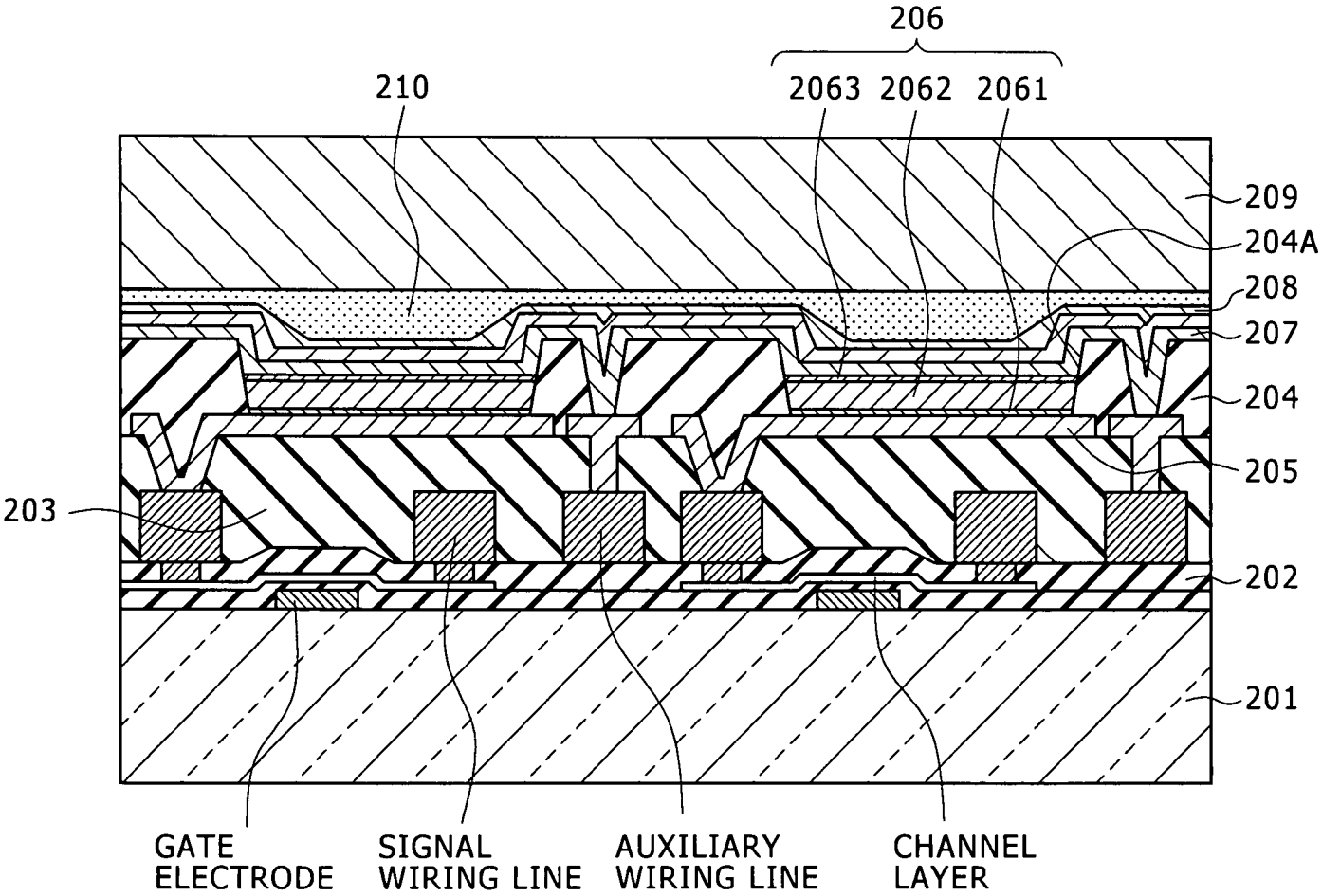
FIG. 3 is a cross sectional view showing an example of a sectional structure of a pixel.

FIG. 3 shows an example of a cross sectional structure of the pixel 20. Referring to FIG. 3, the pixel 20 includes an insulating film 202, an insulating flattening film 203 and a window insulating film 204 formed in order on a glass substrate 201 on which the pixel circuits including the driving transistor 22, writing transistor 23 and so forth are formed. Further, an organic EL device 21 is provided in a recessed portion 204A of the window insulating film 204.

The organic EL device 21 includes an anode electrode 205 made of a metal or the like and formed on the bottom of the recessed portion 204A of the window insulating film 204, an organic layer (electron transport layer, light emitting layer, hole transport layer/hole injection layer) 206 formed on the anode electrode 205. The organic EL device 21 further includes an cathode electrode 207 formed from a transport conductive film or the like commonly to all pixels on the organic layer 206.

In the organic EL device 21, the organic layer 206 is formed from a hole transport layer/hole injection layer 2061, a light emitting layer 2062, an electron transport layer 2063 and an electron injection layer (not shown) successively deposited on the anode electrode 205. When the organic EL device 21 is driven by current from the driving transistor 22, current flows from the driving transistor 22 to the organic layer 206 through the anode electrode 205 such that the light emitting layer 2062 in the organic layer 206 emits light when electrons and holes recombine in the light emitting layer 2062.

After the organic EL device 21 is formed in a unit of a pixel on the glass substrate 201, on which the pixel circuits are formed, with the insulating film 202, insulating flattening film 203 and window insulating film 204 interposed therebetween as seen in FIG. 3, a sealing substrate 209 is adhered to the pixels 20 by a bonding agent 210 with a passivation film 208 interposed therebetween such that the organic EL devices 21 are sealed with the sealing substrate 209 to form the display panel 70.

(Circuit Operation of the Organic EL Display Apparatus of the Reference Example)

Now, basic operation of the organic EL display apparatus 10 according to the reference example is described with reference to FIGS. 4 to 6D. It is to be noted that, in FIGS. 5A to 5D and 6A to 6D, the writing transistor 23 is represented by a symbol of a switch for simplified illustration. Also the EL capacitance 25 of the organic EL device 21 is shown.

Figure 4:
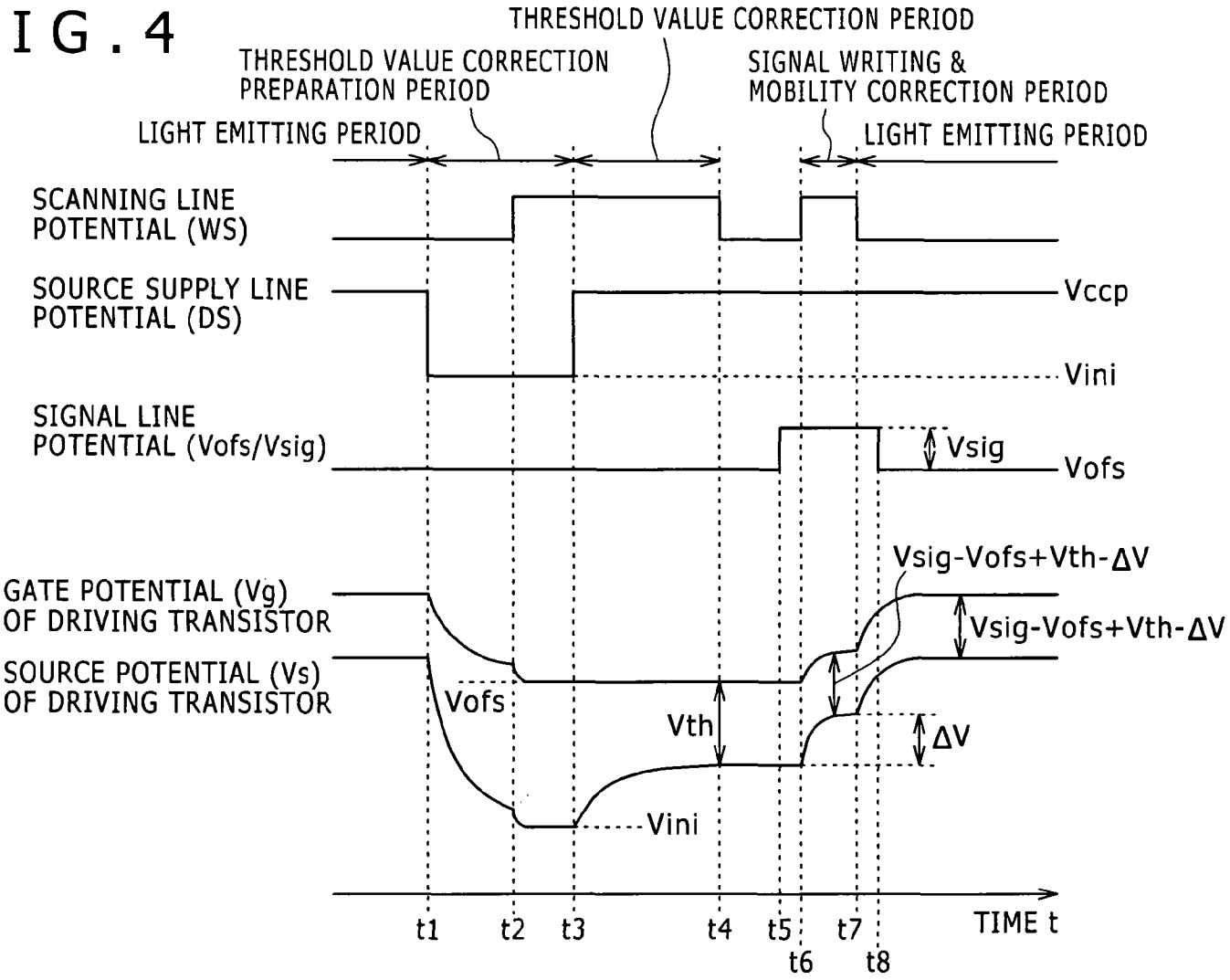
FIG. 4 is a timing waveform diagram illustrating basic operation of the organic EL display apparatus of FIG. 1.

In the timing waveform diagram of FIG. 4, a variation of the potential WS of a scanning line 31 (31-1 to **31-*m*), a variation of the potential (scanning signal/writing signal) DS of a power supply line 32 (32-1 to 32-*m*), a variation of a potential (Vofs/Vsig) of a signal line 33 (33-1 to 33-*n*) and variations of a gate potential Vg and a source potential Vs of the driving transistor 22** within 1 H (H is a horizontal period) are illustrated on the common time axis.

<Light Emitting Period>

In the timing chart of FIG. 4, the organic EL device 21 is in a light emitting state before time t1 (light emitting period). Within this light emitting period, the potential DS of the power supply line 32 is the first potential Vccp and the writing transistor 23 is in a non-conducting state. At this time, since the driving transistor 22 is set so as to operate in a saturation region, driving current or drain-source current Ids which depends upon the gate-source voltage Vgs of the driving transistor 22 is supplied from the power supply line 32 to the organic EL device 21 through the driving transistor 22 as seen from FIG. 5A. Consequently, the organic EL device 21 emits light with a luminance corresponding to the current value of the driving current Ids.

<Threshold Value Correction Preparation Period>

When the time t1 comes, the line sequential scanning enters a new field, and the potential DS of the power supply line 32 changes over from the first potential Vccp to the second potential Vini which is sufficiently lower than the offset voltage Vofs−Vth of the signal line 33.

Here, where the threshold voltage of the organic EL device 21 is represented by Vel and the potential of the common power supply line 34 is represented by Vcath, if the second potential Vini is set to Vini<Vel+Vcath, then since the source potential Vs of the driving transistor 22 becomes substantially equal to the second potential Vini, the organic EL device 21 is placed into a reversely biased state and stops the emission of light.

Figure 5A:
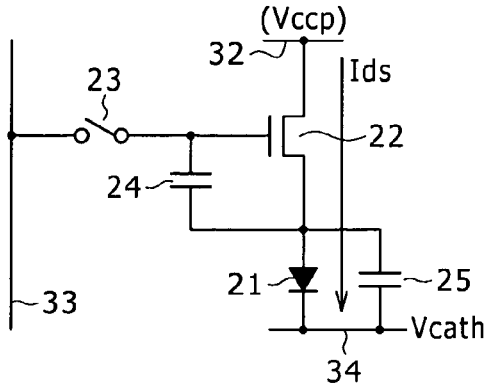
FIGS. 5A to 5D and 6A to 6D are circuit diagrams illustrating circuit operation of the organic EL display apparatus of FIG. 1.
Figure 5B:
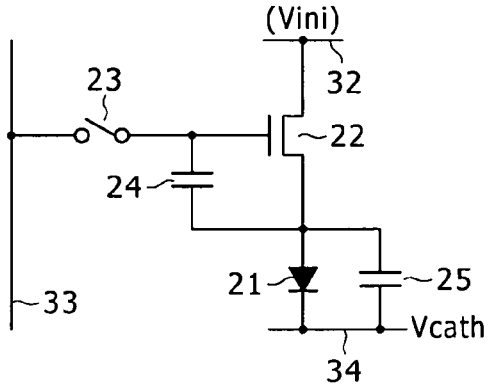
Figure 5C:
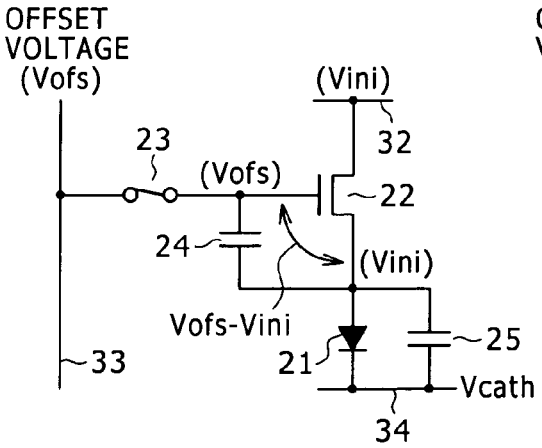

Then at time t2, the potential WS of the scanning line 31 changes from the low potential side to the high potential side, whereupon the writing transistor 23 is placed into a conducting state as seen from FIG. 5C. At this time, since the offset voltage Vofs is supplied from the horizontal driving circuit 60 to the signal line 33, the gate potential Vg of the driving transistor 22 becomes equal to the offset voltage Vofs. Meanwhile, the source potential Vs of the driving transistor 22 remains the second potential Vini which is sufficiently lower than the offset voltage Vofs.

At this time, the gate-source voltage Vgs of the driving transistor 22 is Vofs−Vini. Here, if Vofs−Vini is not sufficiently higher than the threshold voltage Vth of the driving transistor 22, then since a threshold value correction operation hereinafter described cannot be carried out, it is necessary to establish the potential relationship of Vofs−Vini>Vth. Operation of fixing or settling the gate potential Vg and the source potential Vs of the driving transistor 22 to the offset voltage Vofs and the second potential Vini, respectively, in this manner is operation for threshold value correction preparation.

<Threshold Value Correction Period>

Figure 5D:
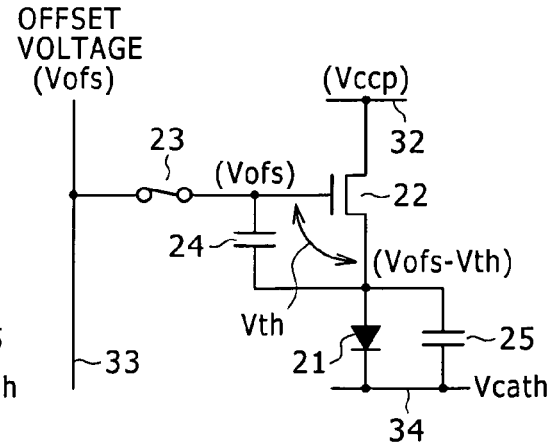

Then at time t3, the potential DS of the power supply line 32 changes over from the second potential Vini to the first potential Vccp as see from FIG. 5D. Thereupon, the source potential Vs of the driving transistor 22 begins to rise. Soon, the gate-source voltage Vgs of the driving transistor 22 converges to the threshold voltage Vth of the driving transistor 22, and a voltage corresponding to the threshold voltage Vth is held into the holding capacitor 24.

Here, the period within which the gate-source voltage Vgs converged to the threshold voltage Vth of the driving transistor 22 is detected and a voltage corresponding to the threshold voltage Vth is held into the holding capacitor 24 is called threshold value correction period for the convenience of description. It is to be noted that, in order to allow current to flow to the holding capacitor 24 without flowing to the organic EL device 21 side within the threshold value correction period, the potential Vcath of the common power supply line 34 is set so that the organic EL device 21 may exhibit a cutoff state.

Figure 6A:
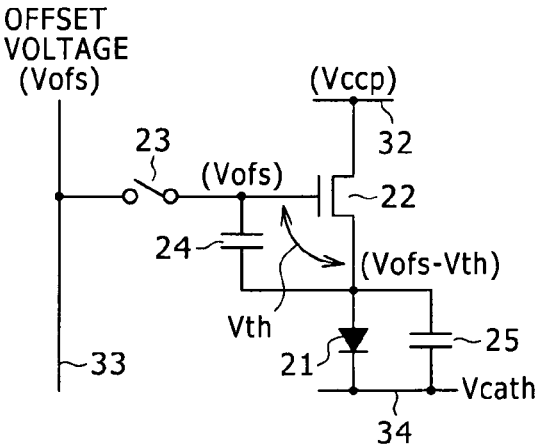

Then, at time t4, the potential WS of the scanning line 31 enters the low potential side, and consequently, the writing transistor 23 is placed into a non-conducting state as seen in FIG. 6A. At this time, the gate electrode of the power supply line 32 enters a floating state, and since the gate-source voltage Vgs is equal to the threshold voltage Vth of the driving transistor 22, the driving transistor 22 enters a cutoff state. Accordingly, the drain-source current Ids does not flow to the driving transistor 22.

<Writing Period/Mobility Correction Period>

Figure 6B:
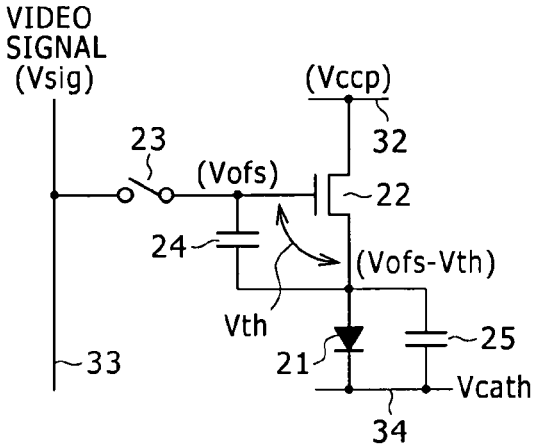
Figure 6C:
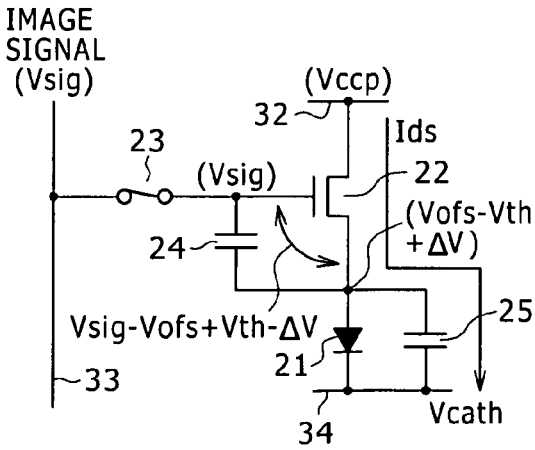

Then at time t5, the potential of the signal line 33 changes over from the offset voltage Vofs to the signal voltage Vsig of the image signal as seen from FIG. 6B. Then at time t6, the potential WS of the scanning line 31 changes to the high potential side, and consequently, the writing transistor 23 enters a conducting state to sample the signal potential Vsig of the image signal and write the sampled signal potential vsig into the pixel 20 as seen from FIG. 6C.

As a result of the writing of the signal voltage Vsig by the writing transistor 23, the gate potential Vg becomes equal to the signal voltage Vsig. Then, upon driving of the driving transistor 22 by the signal potential Vsig of the image signal, the threshold voltage Vth of the driving transistor 22 is canceled by a voltage corresponding to the threshold voltage Vth held in the holding capacitor 24 to carry out threshold value correction. The principle of threshold value correction is hereinafter described.

At this time, since the organic EL device 21 is in a reversely biased state, it is in a cutoff state, that is, in a high impedance state. When the organic EL device 21 is in a reversely biased state, it exhibits a capacitive property. Accordingly, current flowing from the power supply line 32 to the driving transistor 22 in response to the signal potential Vsig of the image signal, that is, the drain-source current Ids, flows into the EL capacitance 25 of the organic EL device 21 to start charging of the EL capacitance 25.

By the charging of the EL capacitance 25, the source potential Vs of the driving transistor 22 rises as time passes. At this time, the dispersion of the threshold voltage Vth of the driving transistor 22 has been compensated for already, and the driving current or drain-source current Ids of the driving transistor 22 relies upon the mobility μ of the driving transistor 22.

Soon the source potential Vs of the driving transistor 22 rises to the potential of Vofs−Vth+ΔV, and thereupon, the gate-source voltage Vgs of the driving transistor 22 becomes Vsig−Vofs+Vth−ΔV. In particular, the rise amount ΔV of the source potential Vs acts so as to be subtracted from the voltage (Vsig−Vofs+Vth) held in the holding capacitor 24, in other words, so as to discharge the accumulated charge of the holding capacitor 24, whereby negative feedback is applied. Accordingly, the rise amount ΔV of the source potential Vs is a feedback amount in the negative feedback.

By negatively feeding back the drain-source current Ids flowing through the driving transistor 22 to the gate input of the driving transistor 22, that is, to the gate-source voltage Vgs of the driving transistor 22 in this manner, mobility correction of canceling the dependency of the drain-source current Ids of the driving transistor 22 upon the mobility μ, that is, of compensating for the dispersion for each pixel of the mobility μ, is carried out.

More particularly, since, as the signal voltage Vsig of the image signal rises, the drain-source current Ids increases, also the absolute value of the feedback amount or correction amount ΔV in the negative feedback increases. Accordingly, mobility correction in accordance with the emission light luminance level is carried out. Further, if the signal voltage Vsig of the image signal is fixed, then since, as the mobility μ of the driving transistor 22 increases, also the absolute value of the feedback amount ΔV in the negative feedback increases, the dispersion of the mobility μ for each pixel can be eliminated. The principle of the mobility correction is hereinafter described.

<Light Emission Period>

Figure 6D:
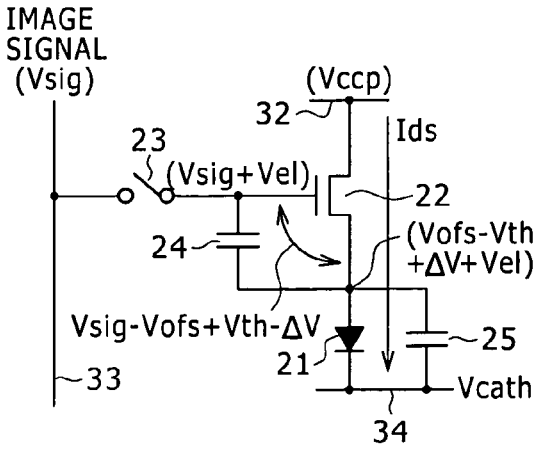

Then at time t7, the potential WS of the scanning line 31 changes to the low potential side, and thereupon, the writing transistor 23 is placed into a non-conducting state as seen in FIG. 6D. Consequently, the gate electrode of the driving transistor 22 is disconnected from the signal line 33 and enters a floating state.

Here, when the gate electrode of the driving transistor 22 is in a floating state, since the holding capacitor 24 is connected between the gate and the source of the driving transistor 22, if the source potential Vs of the driving transistor 22 varies, then also the gate potential Vg of the driving transistor 22 varies in an interlocking relationship with, that is, following up, the variation of the source potential Vs. This is bootstrap operation by the holding capacitor 24.

When the gate electrode of the driving transistor 22 is placed into a floating state and simultaneously the drain-source current Ids of the driving transistor 22 begins to flow through the organic EL device 21, the anode potential of the organic EL device 21 rises in response to the drain-source current Ids of the driving transistor 22.

The rise of the anode potential of the organic EL device 21 is a rise of the source potential Vs of the driving transistor 22. As the source potential Vs of the driving transistor 22 rises, also the gate potential Vg of the driving transistor 22 rises in an interlocking relationship by the bootstrap operation of the holding capacitor 24.

At this time, if it is assumed that the bootstrap gain is 1 which is an ideal value, then the rise amount of the gate potential Vg is equal to the rise amount of the source potential Vs. Therefore, the gate-source voltage Vgs of the driving transistor 22 is kept fixed at Vsig−Vofs+Vth−ΔV within the light emission period. Then, at time t8, the potential of the signal line 33 changes over from the signal voltage Vsig to the offset voltage Vofs.

(Principle of Threshold Value Correction)

Here, the principle of threshold value correction of the driving transistor 22 is described. The driving transistor 22 operates as a constant current source because it is designed so as to operate in a saturation region. Consequently, fixed drain-source current or driving current Ids given by the following expression (1) is supplied from the driving transistor 22:

$$Ids=(1/2)\cdot\mu(W/L)Cox(Vgs-Vth)^2 \quad (1)$$

where W is the channel width of the driving transistor 22, L the channel length, and Cox the gate capacitance per unit area.

Figure 7:
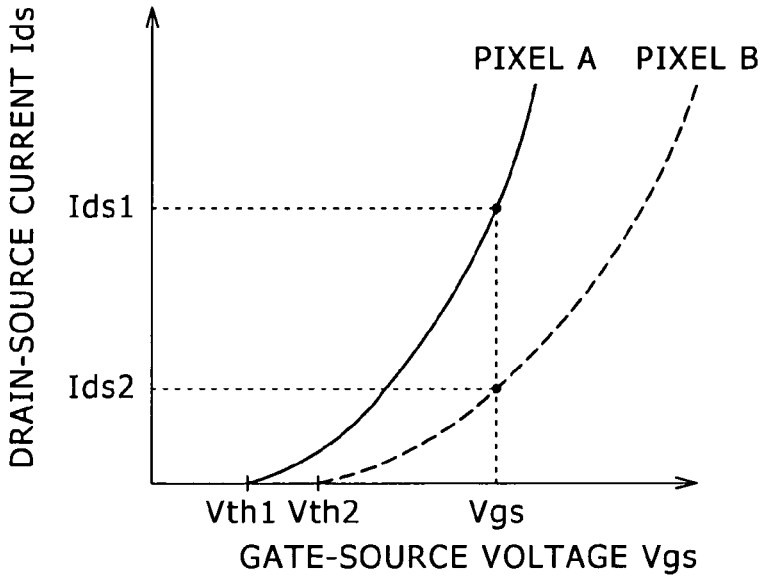
FIG. 7 is a characteristic diagram illustrating a subject of the organic EL display apparatus of FIG. 1 which arises from a dispersion of the threshold voltage of a driving transistor.

FIG. 7 illustrates a characteristic of the drain-source current Ids−gate-source voltage Vgs of the driving transistor 22.

As seen from the characteristic diagram of FIG. 7, if compensation for the dispersion of the threshold voltage Vth of the driving transistor 22 for each pixel is not carried out, then when the threshold voltage Vth is Vth1, the drain-source current Ids corresponding to the gate-source voltage Vgs becomes Ids1.

On the other hand, when the threshold voltage Vth is Vth2 (Vth2>Vth1), the drain-source current Ids corresponding to the same gate-source voltage Vgs is Ids2 (Ids2<Ids). In other words, if the threshold voltage Vth of the driving transistor 22 varies, then the drain-source current Ids varies even if the gate-source voltage Vgs is fixed.

On the other hand, in the pixel or pixel circuit 20 having the configuration described above, since the gate-source voltage Vgs of the driving transistor 22 upon light emission is Vsig−Vofs+Vth−ΔV, by substituting this into the expression (1), the drain-source current Ids is represented by the following expression (2):

$$Ids=(1/2)\cdot\mu(W/L)Cox(Vsig-Vofs-\Delta V)^2 \quad (2)$$

In particular, the item of the threshold voltage Vth of the driving transistor 22 is canceled, and the drain-source current Ids supplied from the driving transistor 22 to the organic EL device 21 does not rely upon the threshold voltage Vth of the driving transistor 22. As a result, even if the threshold voltage Vth of the driving transistor 22 is varied for each pixel by a dispersion of the fabrication process of the driving transistor 22 or by a secular change of the driving transistor 22, since the drain-source current Ids does not vary, the emission light luminance of the organic EL device 21 can be kept fixed.

(Principle of Mobility Correction)

Figure 8:
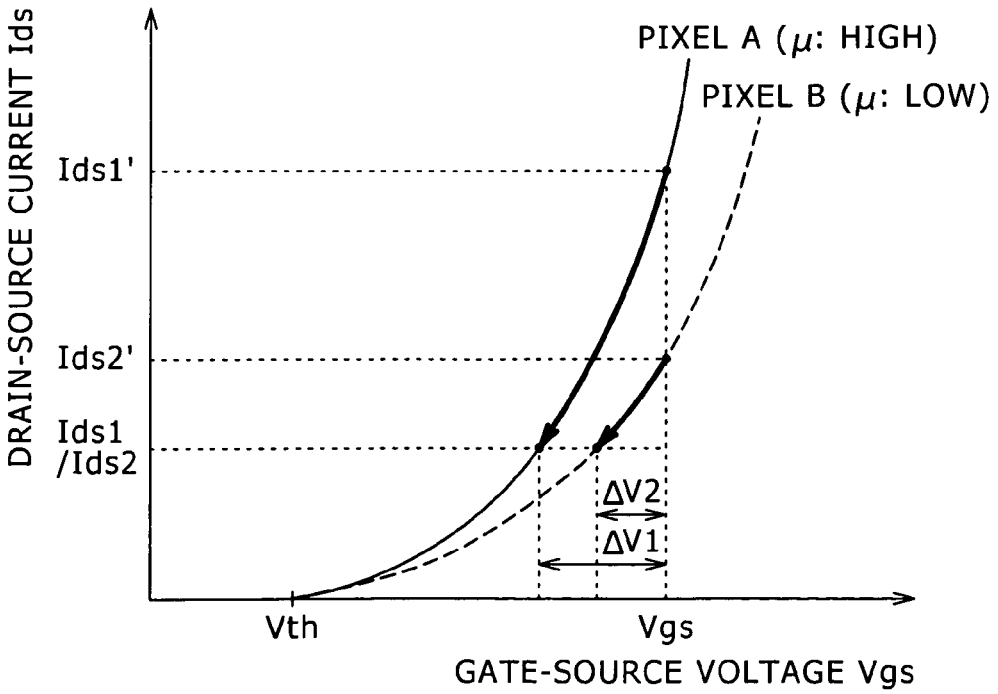
FIG. 8 is a characteristic diagram illustrating another subject of the organic EL display apparatus of FIG. 1 which arises from a dispersion of the mobility of a driving transistor.

Now, the principle of mobility correction of the driving transistor 22 is described. FIG. 8 shows characteristic curves of a pixel A wherein the mobility μ of the driving transistor 22 is relatively high and another pixel B wherein the mobility μ is relatively low for comparison. Where the driving transistor 22 is formed from a polycrystalline silicon thin film transistor, dispersion of the mobility μ between pixels cannot be avoided.

For example, if the signal potentials Vsig of the image signal having the same level are written into the two pixels A and B, then a great difference appears between drain-source current Ids1' flowing through the pixel A having the high mobility μ and drain-source current Ids2' flowing through the pixel B having the low mobility μ. If a great difference is caused to appear in the drain-source current Ids by the dispersion of the mobility μ for each pixel in this manner, then the uniformity of the screen image is damaged.

Here, as can be apparent from the transistor characteristic expression (1) given hereinabove, as the mobility μ increases, the drain-source current Ids increases. Accordingly, as the mobility μ increases, the feedback amount ΔV in the negative feedback increases. As illustrated in FIG. 8, the feedback amount ΔV1 of the pixel A having the high mobility μ is greater than the feedback amount ΔV2 of the pixel B having the low mobility μ.

Therefore, by negatively feeding back the drain-source current Ids of the driving transistor 22 to the signal voltage Vsig side of the image signal by the mobility correction operation, as the mobility μ increases, the amount of the negative feedback increases, and consequently, the dispersion of the mobility μ for each pixel can be suppressed.

In particular, if correction of the feedback amount ΔV1 is carried out for the pixel A having the high mobility μ, then the drain-source current Ids drops by a great amount from Ids1' to Ids1. On the other hand, since the feedback amount ΔV2 of the pixel B having the low mobility μ is small, the drain-source current Ids drops from Ids2' to Ids2. As a result, the drain-source current Ids1 of the pixel A and the drain-source current Ids2 of the pixel B becomes substantially equal to each other, and therefore, the dispersion of the mobility μ for each pixel is compensated for.

In summary, where the pixel A and the pixel B are different in mobility μ, the feedback amount ΔV1 of the pixel A having the high mobility μ is greater than the feedback amount ΔV2 of the pixel B having the low mobility μ. In short, as the mobility μ increases, the feedback amount ΔV increases and the reduction amount of the drain-source current Ids increases.

Accordingly, by negatively feeding back the drain-source current Ids of the driving transistor 22 to the signal voltage Vsig side of the image signal, the current values of the drain-source current Ids of pixels which are different in mobility μ are uniformized. As a result, the dispersion of the mobility μ for each pixel can be compensated for.

Here, a relationship between the signal potential or sampling potential Vsig of the image signal and the drain-source current Ids of the driving transistor 22 which depends upon whether or not threshold value correction or mobility correction is carried out in the pixel or pixel circuit 20 shown in FIG. 2 is described with reference to FIGS. 9A to 9C.

Figure 9A:
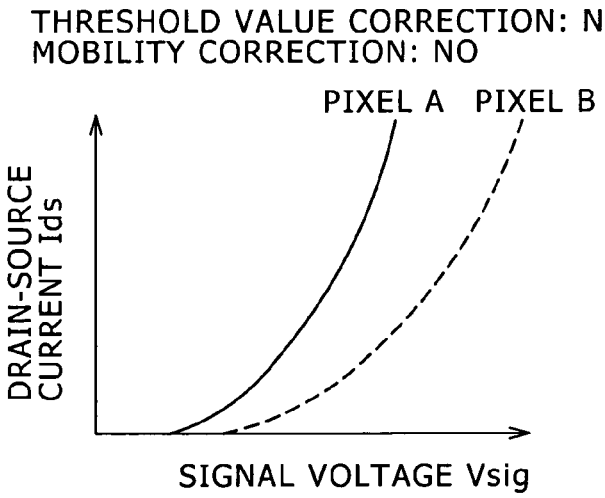
FIGS. 9A to 9C are characteristic diagrams illustrating relationships between a signal voltage of an image signal and drain-source current of the driving transistor which depend upon whether or not threshold value correction and/or mobility correction is carried out.
Figure 9B:
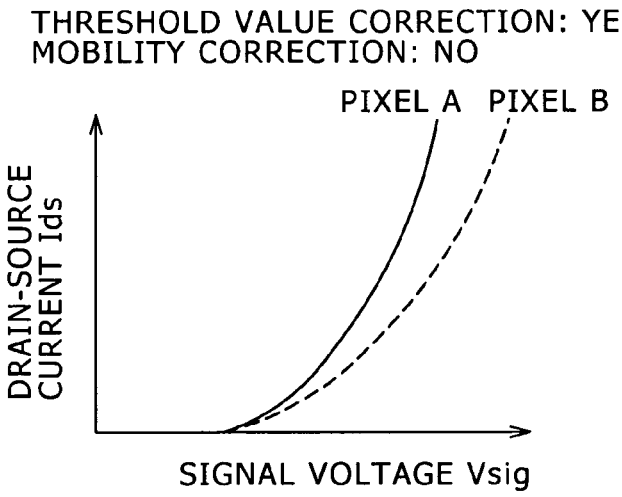
Figure 9C:
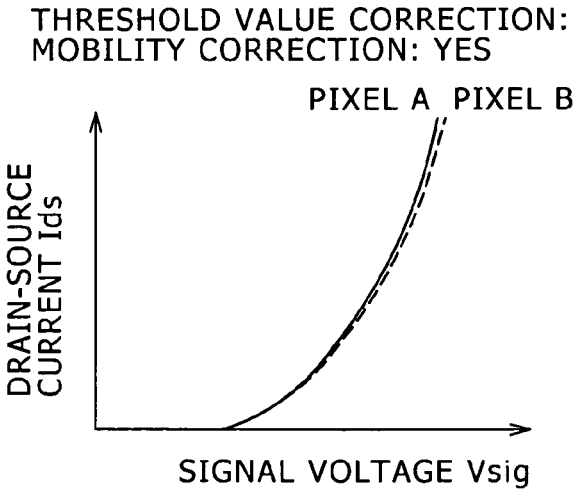

Referring to FIGS. 9A to 9C, FIG. 9A illustrates the relationship where none of the threshold value correction and the mobility correction is carried out; FIG. 9B illustrates the relationship where only the threshold value correction is carried out while the mobility correction is not carried out; and FIG. 9C illustrates the relationship where both of the threshold value correction and the mobility correction are carried out. Where none of the threshold value correction and the mobility correction is carried out as seen in FIG. 9A, a great difference in the drain-source current Ids originating from the dispersion in the threshold value voltage Vth and the mobility μ for each of the pixels A and B appears between the pixels A and B.

In contrast, where only the threshold value correction is carried out, although the dispersion of the drain-source current Ids can be reduced to some degree by the threshold value correction, the difference in drain-source current Ids between the pixels A and B originating from the dispersion in mobility μ between the pixels A and B remains.

Then, where both of the threshold value correction and the mobility correction are carried out, the difference in drain-source current Ids between the pixels A and B originating from the dispersion in threshold value voltage Vth and mobility μ for each of the pixels A and B can be almost eliminated as seen in FIG. 9C. Therefore, a luminance dispersion of the organic EL device 21 does not appear in any gradation, and a display image of good picture quality can be obtained.

Since the pixel 20 shown in FIG. 2 includes the bootstrap function described above in addition to the correction functions including the threshold value correction and mobility correction functions, the following working effects can be anticipated.

In particular, even if the I-V characteristic of the organic EL device 21 undergoes secular change and this varies the source potential Vs of the driving transistor 22, since the gate-source voltage Vgs of the driving transistor 22 is kept fixed by the bootstrap operation by the holding capacitor 24, the current flowing through the organic EL device 21 does not vary. Accordingly, since the emission light luminance of the organic EL device 21 is kept fixed, even if the I-V characteristic of the organic EL device 21 undergoes secular change, image display free from luminance deterioration can be implemented.

As apparent from the foregoing description, while, in the organic EL display apparatus 10 of the reference example, a pixel 20 which forms a sub pixel has a pixel configuration which includes two transistors of the driving transistor 22 and the writing transistor 23, the organic EL display apparatus 10 can implement the compensation function for the characteristic variation of the organic EL device 21 and the correction functions for threshold value correction and mobility correction similarly to the organic EL display apparatus disclosed in Japanese Patent Laid-Open No. 2006-133542 which has the pixel configuration including several transistors in addition to the two aforementioned transistors. Further, with the organic EL display apparatus 10, since the number of component devices of the pixel 20 is reduced, the pixel size can be reduced as much, and higher definition of the display apparatus can be anticipated.

[Problems Involved in Enhancement of Definition]

In this manner, the pixel 20 including the two transistors of the driving transistor 22 and the writing transistor 23 is advantageous in enhancement of the definition of a display apparatus because the number of component devices is comparatively small. However, as the enhancement of the definition further advances until a fine pixel corresponding to ultrahigh definition such as panel definition of 300 ppi (pixel per inch), even if a pixel includes a comparatively small number of component devices such as the driving transistor 22, writing transistor 23 and holding capacitor 24 (and may include a sub capacitor for supplementing shortage of the EL capacitance), it becomes difficult to lay out such component devices in the pixel 20.

Figure 10:
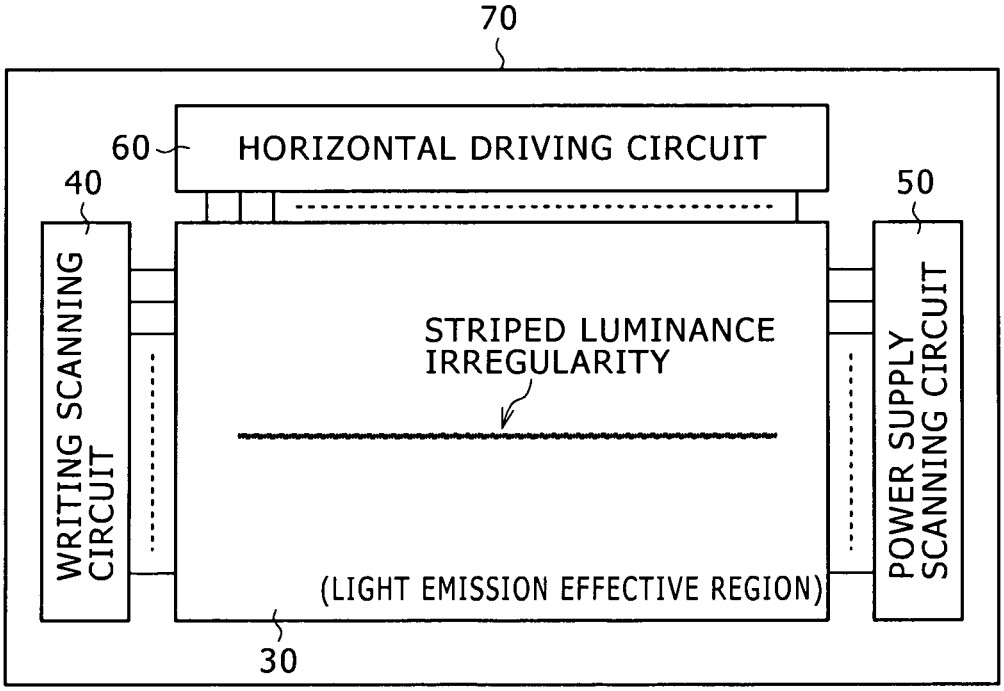
FIG. 10 is a schematic view illustrating a manner of striped luminance irregularity which appears when the optimum correction time period for mobility correction is excessively short.

Further, since the optimum correction time period t of mobility correction is given by the expression of $t=C/k\mu Vsig$ and is determined by the capacitance value C of the pixel capacitor as described hereinabove, if the reduction of the pixel size advances until it becomes impossible to assure a sufficient capacitance value C of the pixel capacitor, the optimum correction time period t of mobility correction becomes shorter. As the optimum correction time period t becomes shorter, the influence of the dispersion of the correction time arising from the dispersion of a pulse which defines the mobility correction period (t6–t7 of FIG. 4) increases. As a result, striped luminance irregularity extending horizontally or like irregularity appears on the display screen or in the light emission effective region as seen in FIG. 10.

[Characteristic Portions of the Embodiment]

Therefore, the organic EL display apparatus according to an embodiment of the present invention is configured such that a plurality of pixels (sub pixels) in the same pixel row of the pixel array section 30 are determined as a unit and the pixel circuit for one pixel other than the organic EL device 21, that is, a pixel circuit which includes the driving transistor 22, writing transistor 23 and holding capacitor 24 (and may include a sub capacitor) and drives the organic EL device 21, is provided commonly to the plurality of pixels of the unit such that the pixel circuit selectively places the organic EL devices 21 for the plural pixels into a forwardly biased state to time-divisionally drive the plural organic EL devices 21.

Figure 11:
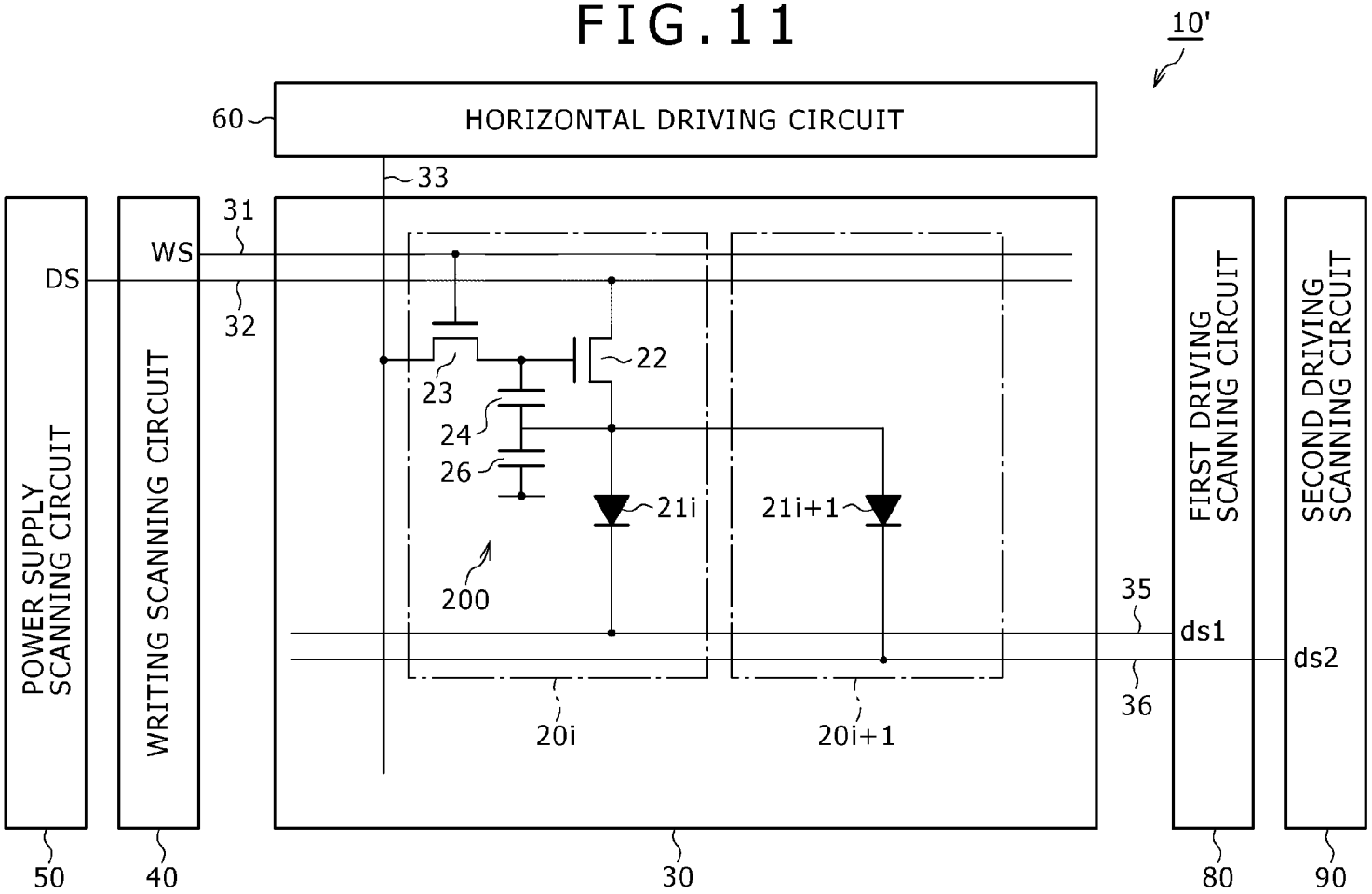
FIG. 11 is a system diagram showing a general configuration of an organic EL display apparatus to which the present invention is applied.

FIG. 11 shows a general configuration of a display apparatus according to an embodiment of the present invention.

Also in the present embodiment, an active matrix type organic EL display apparatus is described as an example wherein an electro-optical device of the current driven type whose emission light luminance varies in response to the value of current flowing through the device, for example, an organic EL device, that is, an organic electroluminescence light emitting device, is used as a light emitting device of a pixel or pixel circuit In the organic EL display apparatus 10' according to the present embodiment, a plurality of pixels, for example, two pixels, in the same pixel row of the pixel array section 30 are determined as a unit and a pixel circuit for one pixel other than the organic EL device 21 is provided commonly to the plural pixels of the unit. Further, in FIG. 11, a configuration of the pixel circuit of two pixels 20*i* and 20*i*+1 adjacent each other in a certain pixel row is shown schematically.

(Pixel Circuit)

Organic EL devices 21*i* and 21*i*+1 are provided in pixels 20*i* and 20*i*+1, respectively. Meanwhile, a pixel circuit for driving the organic EL devices 21*i* and 21*i*+1, in particular, a pixel circuit 200 which includes a driving transistor 22, a writing transistor 23 and a holding capacitor 24 and drives the organic EL devices 21*i* and 21*i*+1, is provided commonly to the two pixels 20*i* and 20*i*+1.

The pixel circuit 200 in the present embodiment includes, in addition to the driving transistor 22, writing transistor 23 and holding capacitor 24, a sub capacitor 26 for supplementing shortage of the capacity of the organic EL devices 21*i* and 21*i*+1. The sub capacitor 26 is connected at one end thereof, that is, at one terminal thereof, to the source electrode of the driving transistor 22, and at the other end thereof, that is, at the other terminal thereof, to a fixed voltage Vcc. The sub capacitor 26 has a function of supplementing shortage of the writing gain G or input gain of an image signal by supplementing shortage of the capacitance of the organic EL devices 21*i* and 21*i*+1 as apparent from the description of operation given hereinbelow.

In order to selectively and time-divisionally drive the organic EL devices 21*i* and 21*i*+1 using the pixel circuit 200, in the reference example described hereinabove, the common power supply line 34 (refer to FIG. 2) is wired to the anode electrode of the organic EL device 21 commonly to all pixels. In contrast, in the present embodiment, first and second driving lines 35 and 36 are wired separately for the cathode electrodes of the organic EL device 21*i* and the organic EL device 21*i*+1 such that the cathode potentials of the organic EL devices 21*i* and 21*i*+1 are controlled through the first and second driving lines 35 and 36 by first and second driving scanning circuits 80 and 90, respectively.

It is to be noted that, while only a connection relationship of the cathode electrodes of the organic EL devices 21*i* and 21*i*+1 to the first and second driving lines 35 and 36 is illustrated in FIG. 11, the cathode electrodes of a group composed of every other organic devices including the organic EL device 21*i* in a pixel row same as that of the organic EL devices 21*i* and 21*i*+1 are connected commonly to the first driving line 35. Meanwhile, the cathode electrodes of another group composed of the remaining every other organic devices including the organic EL device 21*i*+1 in a pixel row same as that of the organic EL devices 21*i* and 21*i*+1 are connected commonly to the second driving line 36. This similarly applies also to the other pixel rows.

Each of the first and second driving scanning circuits 80 and 90 is formed from a shift register or the like similarly to the writing scanning circuit 40 and the power supply scanning circuit 50, and suitably outputs, upon selective driving of the organic EL devices 21*i* and 21*i*+1, the first driving signal ds1 or the second driving signal ds2 within a period of one field (one frame) for each pixel row so as to be applied to the cathode electrode of the organic EL device 21*i* or 21*i*+1 through the first driving line 35 or the second driving line 36.

Here, the first and second driving signals ds1 and ds2 are pulse signals and, where the low potential Vini of the potential DS of the power supply line 32 is, for example, the ground level, that is, 0 V, they are set, on the high potential side thereof, to a voltage higher than the threshold voltage Vel of the organic EL devices 21*i* and 21*i*+1 with respect to the ground level, for example, to a voltage of approximately 10 V. As regards the low potential side of the first and second driving signals ds1 and ds2, when the potential DS of the power supply line 32 is the high potential Vccp, the first and second driving signals ds1 and ds2 are set to a potential with which the organic EL devices 21*i* and 21*i*+1 are placed in a forwardly biased state, for example, to 0 V.

In the above-described potential relationship of the high potentials of the first and second driving signals ds1 and ds2 with respect to the low potential Vini of the potential DS, as apparent from the foregoing description of the circuit operation of the reference example, within the series of operation periods of threshold value correction, signal writing and mobility correction, the first and second driving scanning circuits 80 and 90 output a high potential as the first and second driving signals ds1 and ds2 and provides the first and second driving signals ds1 and ds2 to the organic EL devices 21*i* and 21*i*+1. Consequently, the organic EL devices 21*i* and 21*i*+1 are placed into a reversely biased state and indicate the capacitive property. Details of the timing relationship of the first and second driving signals ds1 and ds2 are hereinafter described.

(Pixel Structure)

The pixel structure of the pixels 20*i* and 20*i*+1 is basically same as the pixel structure of the pixel 20 shown in FIG. 3. As can be seen apparently from the pixel structure of FIG. 3, the pixel circuit 200 including the driving transistor 22, writing transistor 23, holding capacitor 24 and sub capacitor 26 are formed in a TFT layer on the glass substrate 201 while the organic EL device 21 is formed at the recessed portion 204A of the window insulating film 204.

Since the layer in which the pixel circuit 200 is formed and the layer in which the organic EL device 21 is formed are different from each other in this manner, even if the pixel circuit 200 is provided commonly to the pixels 20*i* and 20*i*+1, the organic EL devices 21*i* and 21*i*+1 can be formed for each of the pixels 20*i* and 20*i*+1 disposed in a matrix in a fixed pitch.

On the other hand, as the layout area per one pixel circuit 200, an area corresponding to two pixels of the pixels 20*i* and 20*i*+1 can be assured. Further, since the pixel circuit 200 does not exist for one of the pixels 20*i* and 20*i*+1, if this is taken into consideration, then the layout area of the holding capacitor 24 and the sub capacitor 26 can be assured twice that or more where the pixel circuit 200 is disposed for each pixel.

Here, that the layout area of the holding capacitor 24 and the sub capacitor 26 can be assured twice or more signifies that the area of parallel flat plates for forming the capacitors 24 and 26 can be increased to twice or more. Then, since the capacitance value of a capacitor formed between parallel flat plates increases in proportion to the area of the parallel flat plates, the layout area of the holding capacitor 24 and the sub capacitor 26 can be assured twice or more. Therefore, the capacitance value of each of the holding capacitor 24 and the sub capacitor 26 can be set to twice or more in comparison with that where the pixel circuit 200 is disposed for each pixel.

The first and second driving lines 35 and 36 which provide the first and second driving signals ds1 and ds2 to the cathode electrodes of the organic EL devices 21*i* and 21*i*+1 correspond to the cathode electrode 207 in the pixel structure of FIG. 3. In particular, as apparently seen from the pixel structure of FIG. 3, while the pixel circuit 200 including the driving transistor 22, writing transistor 23, holding capacitor 24 and sub capacitor 26 is formed in the TFT layer on the glass substrate 201, the first and second driving lines 35 and 36 are formed on the window insulating film 204.

Since the first and second driving lines 35 and 36 are formed in a layer different from the TFT layer in which the pixel circuit 200 is formed, even if the potentials of the first and second driving signals ds1 and ds2 as pulse signals vary and the potentials of the first and second driving lines 35 and 36 are fluctuated by such variation, there is no possibility that the circuit operation of the pixel circuit 200 may be influenced by the fluctuation of the potential.

(Circuit Operation of the Organic EL Display Apparatus)

Now, circuit operation of the organic EL display apparatus 10' according to the present embodiment is described with reference to FIG. 12.

Figure 12:
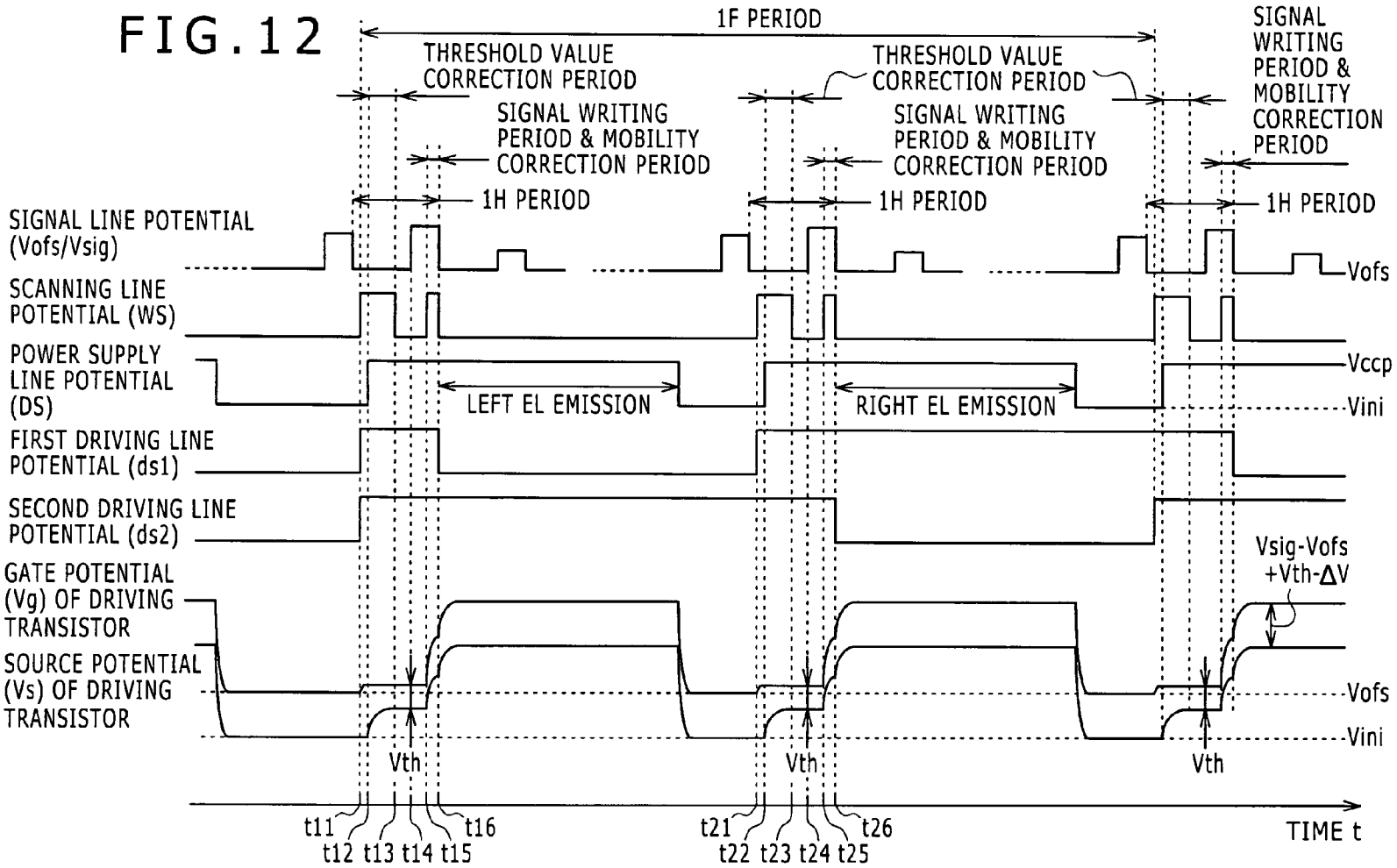
FIG. 12 is a timing waveform diagram illustrating operation of the organic EL display apparatus of FIG. 11.

FIG. 12 illustrates a variation of a potential (Vofs/Vsig) of a signal line 33 (33-1 to 33-*n*), a variation of the potential or potential WS of a scanning line 31, a variation of the potential DS of a power supply line 32, variations of the potentials or first and second driving signals ds1 and ds2 of first and second driving lines 35 and 36, and variations of a gate voltage Vg and a source potential Vs of the driving transistor 22 within 1F (F is a field/frame period).

It is to be noted that particular operations of threshold value correction preparation, pixel value correction, signal writing & mobility correction and light emission of each of the pixels 20*i* and 20*i*+1 are basically same as those of the circuit operation of the organic EL display apparatus 10 according to the reference example described hereinabove.

In a no-light emitting state, the potential WS of the scanning line 31 changes from the low potential side to the high potential side at time t11, and simultaneously, the first and second driving signals ds1 and ds2 change from the low potential side to the high potential side. The time t11 corresponds to the time t2 in the timing waveform diagram of FIG. 4.

At this time, the potential of the signal line 33 is the offset voltage Vofs, and the offset voltage Vofs is written into the gate electrode of the driving transistor 22 by the writing transistor 23. Meanwhile, since both of the first and second driving signals ds1 and ds2 of the first and second driving lines 35 and 36 are the high potential and the potential DS of the power supply line 32 is the low potential Vini, both of the organic EL devices 21*i* and 21*i*+1 are in a reversely biased state and exhibit a capacitive property (EL capacitance).

Then at time t12, the potential DS of the power supply line 32 changes from the low potential Vini to the high potential Vccp, and consequently, threshold value correction operation is started. The time t12 corresponds to the time t3 in the timing waveform diagram of FIG. 4. The threshold value correction operation is carried out within a period, that is, within a threshold value correction period, from time t12 to time t13 at which the potential WS of the scanning line 31 changes from the high potential side to the low potential side.

Here, if the capacitance of the EL capacity of the organic EL device 21*i* is represented by Celi and the capacitance of the EL capacity of the organic EL device 21*i*+1 is represented by Celi+1, then for the capacitance value C of the pixel capacitor in the threshold value correction operation, the capacitance values Celi and Celi+1 of the EL capacitors of the organic EL devices 21*i* and 21*i*+1 are used in addition to the capacitance value Cs of the holding capacitor 24 and the capacitance value Csub of the sub capacitor 26.

Then at time t14, the signal voltage Vsig of the image signal is supplied from the horizontal driving circuit 60 to the signal line 33. Then at time t15, the potential WS of the scanning line 31 changes from the low potential side to the high potential side again. Consequently, the signal voltage Vsig of the image signal is written into the gate electrode of the driving transistor 22 by the writing transistor 23. The time t14 and the time t15 correspond to the time t5 and the time t6 in the timing waveform diagram of FIG. 4.

The signal voltage Vsig thus written in is held in the holding capacitor 24. At this time, since the organic EL devices 21*i* and 21*i*+1 are in a state wherein both of them are connected to the source electrode of the driving transistor 22, the gate-source voltage Vgs actually held in the holding capacitor 24 is represented by the following description (3):

$$Vgs=Vsig\times\{1-Cs/(Cs+Csub+Celi+Celi+1)\} \quad (3)$$

Accordingly, the ratio of the gate-source voltage Vgs to the signal voltage Vsig, that is, the write gain (input gain) G (=Vgs/Vsig) when the signal voltage Vsig of the image signal is written in is given by the following expression (4):

$$G=1-Cs/(Cs+Csub+Celi+Celi+1) \quad (4)$$

As apparently recognized from the expression (4), the capacitance value Cs of the holding capacitor 24 and the capacitance value Csub of the sub capacitor 26 can be increased to twice or more in comparison with those where the pixel circuit 200 is disposed for each pixel. Besides, since the two organic EL devices 21*i* and 21*i*+1 are connected in parallel to the single driving transistor 22, also the EL capacitance can be doubled, and therefore, the write gain G can be set higher than that where the pixel circuit 200 is disposed for each pixel.

Furthermore, although mobility correction is carried out simultaneously with signal writing, for the capacitance value C of the pixel capacitor in this mobility correction operation, (Cs+Csub+Celi+Celi+1) is used. In other words, the capacitance value C of the pixel capacitor can be almost doubled in comparison with that where the pixel circuit 200 is disposed for each pixel.

As described above, since the optimum correction time period t in the mobility correction is given by the expression of t=C/(kμVsig), where the capacitance value C of the pixel capacitor (holding capacitor 24, EL capacitor 25 and sub capacitor 26) is almost doubled, the optimum correction time period t of mobility correction can be set to approximately twice. Therefore, sufficient time can be set for the optimum correction time period t. Consequently, since a sufficient mobility correction dispersion margin can be obtained also with a high definition pixel, mobility correction operation can be carried out with certainty, and therefore, high picture quality can be achieved.

Then at time t16, the potential WS of the scanning line 31 changes from the high potential side to the low potential side, and simultaneously the first driving signal ds1 of the first driving line 35 changes from the high potential to the low potential to place the organic EL device 21*i* of the pixel 20*i* side, from which light is to be emitted, thereby entering a light emitting period. At this time, the second driving signal ds2 of the second driving line 36 on the opposite pixel 20*i*+1, from which light is not to be emitted, is kept at the high potential to leave the organic EL device 21*i*+1 in the reversely biased state.

Since the gate-source voltage Vgs of the driving transistor 22 for which the threshold value correction and the mobility correction have been carried out is held in the holding capacitor 24 of the pixel circuit 200 regardless of the changing over operation between the light emitting state and the no-light emitting state, current of a value as designed can be supplied to the organic EL device 21*i* on the pixel 20*i* side to cause the organic EL device 21*i* to emit light.

The series of operations for the pixel 20*i*, that is, the threshold value correction, signal writing and mobility correction and light emitting operations, end therewith. Then, after a ½ F period, operations similar to the series of operations for the pixel 20*i* are carried out for the pixel 20*i*+1 to place the organic EL device 21*i*+1 on the pixel 20*i*+1 side into a light emitting state and place the organic EL device 21*i* on the pixel 20*i* side into a no-light emitting state.

In particular, the potential WS of the scanning line 31 changes from the low potential side to the high potential side, and simultaneously the first driving signal ds1 of the first driving line 35 changes from the low potential side to the high potential side. At this time, the potential ds2 of the second driving line 36 remains the high potential to which it changed at time t11.

At time t21, the potential of the signal line 33 remains the offset voltage Vofs, and the offset voltage Vofs is written into the gate electrode of the driving transistor 22 by the writing transistor 23. Further, both of the first and second driving signals ds1 and ds2 of the first and second driving lines 35 and 36 are the high potential and the potential DS of the power supply line 32 is the low potential Vini, and consequently, both of the organic EL devices 21*i* and 21*i*+1 are in a reversely biased state and indicate a capacitive property.

Then at step t22, the potential DS of the power supply line 32 changes over from the low potential Vini to the high potential Vccp to start threshold value correction operation. In this threshold value correction operation, for the capacitance value C of the pixel capacitor, the capacitance values Celi and Celi+1 of the EL capacitors of the organic EL devices 21*i* and 21*i*+1 are used in addition to the capacitance value Cs of the holding capacitor 24 and the capacitance value Csub of the sub capacitor 26.

Then at time t24, the signal voltage Vsig of the image signal is supplied from the horizontal driving circuit 60 to the signal line 33, and then at time t25, the potential WS of the scanning line 31 changes from the low potential side to the high potential side again. Consequently, the signal voltage Vsig of the image signal is written into the gate electrode of the driving transistor 22 by the writing transistor 23.

Then at time 26, the potential WS of the scanning line 31 changes from the high potential side to the low potential side, and simultaneously the second driving signal ds2 of the second driving line 36 changes from the high potential side to the low potential side. Consequently, the organic EL device 21*i*+1 on the pixel 20*i*+1, from which light is to be emitted, is placed into a forwardly biased state, thereby entering a light emitting period. At this time, the first driving signal ds1 of the first driving line 35 on the pixel 20*i* side, from which light is to be emitted is kept the high potential so that the organic EL device 21*i* remains in the reversely biased state.

(Working Effects of the Embodiment)

As described above, since the configuration that a plurality of pixels in the same pixel row of the pixel array section 30, for example, two pixels 20*i* and 20*i*+1, are determined as a unit and the pixel circuit 200 for one pixel other than the organic EL devices 21*i* and 21*i*+1 is provided commonly to the two pixels 20*i* and 20*i*+1 of the unit such that the pixel circuit 200 selectively and time-divisionally drives the organic EL devices 21*i* and 21*i*+1 for a period of one field (one frame) is adopted, the layout area for the holding capacitor 24 and the sub capacitor 26 can be increased to twice or more in comparison with that in an alternative case wherein the pixel circuit 200 is disposed for each pixel. Consequently, the capacitance value Cs of the holding capacitor 24 and the capacitance value Csub of the sub capacitor 26 can be increased to twice or more.

Besides, upon such correction operations as a threshold value correction operation and a mobility correction operation, since the organic EL devices 21*i* and 21*i*+1 are connected in parallel to the one driving transistor 22, also the EL capacitance Cel can be doubled (Cel=Celi+Celi+1).

Where, in comparison with the alternative case wherein the pixel circuit 200 is disposed for each pixel, the capacitance value Cs of the holding capacitor 24 and the capacitance value Csub of the sub capacitor 26 increase to twice or more and the EL capacitance Cel becomes doubled upon correction operation, since it is possible to assure a sufficient period of time for each of the correction time periods for threshold value correction and mobility correction which depend upon the capacitance values Cs, Ssub and Cel, respectively, particularly for the optimum correction time period t of the mobility correction and then to carry out the mobility correction operation with certainty, enhancement of the picture quality of the display screen image, particularly in terms of uniformity, can be anticipated.

As regards the number of transistors, although two transistors are used for a unit pixel which uniformizes pixel circuits, in the present embodiment, since the unit pixel corresponds to two sub pixels, the pixel configuration includes one transistor per one sub pixel. In particular, in the present embodiment, the number of transistors per one sub pixel can be reduced to one half that of the reference example which has a pixel configuration including two transistors per one sub pixel. On the contrary, where there is no necessity to increase the layout area of the holding capacitor 24 or the sub capacitor 26 to twice or more, refinement of the sub pixels (pixels) as much can be anticipated.

While, in the embodiment described above, the pixel circuit 200 includes the sub capacitor 26, the sub capacitor 26 is not an essential component, but the present invention can be applied also where the pixel circuit 200 does not include the sub capacitor 26. Also where the pixel circuit 200 does not include the sub capacitor 26, if the present invention is applied, then the capacitance value Cs of the holding capacitor 24 can be increased, and consequently, sufficient time can be assured for the optimum correction time period t of mobility correction.

Further, while, in the embodiment described above, where the low potential Vini of the potential DS of the power supply line 32 is set, for example, to 0 V, within a period within which threshold value correction and mobility correction are carried out, both of the first and second driving signals ds1 and ds2 of the first and second driving lines 35 and 36 are set to the high potential to place the organic EL devices 21*i* and 21*i*+1 into a reversely biased state or cutoff state to use the organic EL devices 21*i* and 21*i*+1 as capacitors (EL capacitors), this is a mere example.

Figure 13:
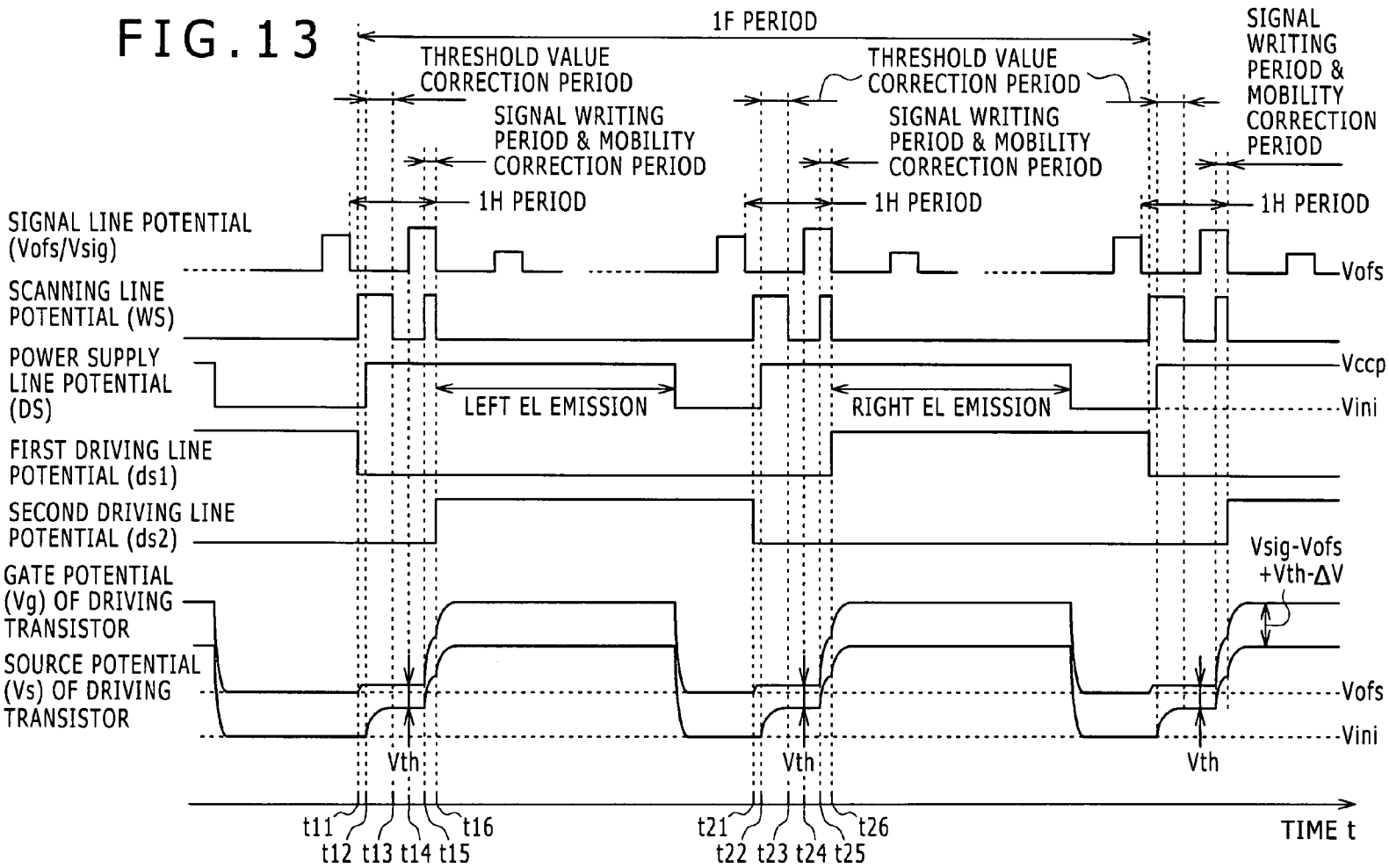
FIG. 13 is a timing waveform diagram illustrating operation of a modification to the organic EL display apparatus of FIG. 11.

For example, if the low potential Vini of the potential DS of the power supply line 32 is set to a potential lower by a fixed voltage than 0 V, for example, to a potential of approximately −4 V and, within a period within which threshold value correction and mobility correction are carried out, both of the first and second driving signals ds1 and ds2 of the first and second driving lines 35 and 36 are set to a low potential, for example, 0 V as seen from a timing waveform diagram of FIG. 13 to apply a reverse bias to the organic EL devices 21*i* and 21*i*+1 to place the organic EL devices 21*i* and 21*i*+1 into a cutoff state, then the organic EL devices 21*i* and 21*i*+1 can be used as capacitors.

Further, while, in the embodiment described above, the present invention is applied to the organic EL display apparatus 10 of the pixel configuration which includes the driving transistor 22 for driving the organic EL device 21, the writing transistor 23 for writing the signal voltage Vsig of the image signal and the holding capacitor 24 for holding the signal voltage Vsig of the image signal written by the writing transistor 23 and the potential DS to be provided to the drain electrode of the driving transistor 22 is changed over between the high potential Vccp and the low potential Vini while the offset voltage Vofs is selectively written from the signal line 33, the present invention is not limited to the application of the pixel configuration which includes two transistors as pixel transistors.

Figure 14:
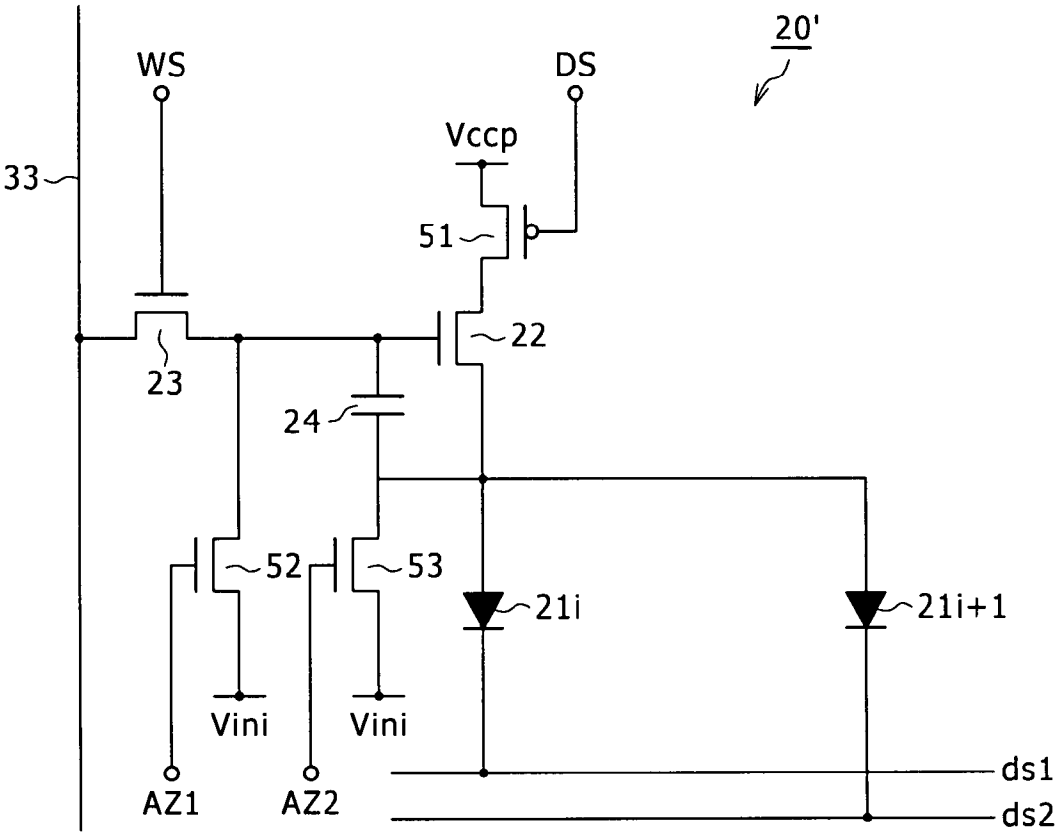
FIG. 14 is a circuit diagram showing another pixel configuration of the organic EL display apparatus of FIG. 11.

In particular, the present invention can be applied similarly to an organic EL display apparatus which has such another pixel configuration as shown in FIG. 14. Referring to FIG. 14, the pixel 20' shown includes, in addition to the transistors 21, 22, 23 and 24 described hereinabove, a switching transistor 51 for controlling the organic EL device 21 between a light emitting state and a no-light emitting state. The pixel 20' further includes switching transistors 52 and 53 which are suitably placed into a conducting state prior to current driving of the organic EL device 21 to initialize the gate potential Vg and the source potential Vs of the driving transistor 22 to the offset voltage Vofs and the low potential Vini, respectively, detecting the threshold value voltage Vth of the driving transistor 22 and placing the threshold value voltage Vth into the holding capacitor 24 so as to be held by the holding capacitor 24.

Further, while, in the embodiment described above, the electro-optical system of the pixel 20 is applied to the organic EL display apparatus which uses organic EL devices, the present invention is not limited to this application. In particular, the present invention can be applied also to various display apparatus which use electro-optical devices or light emitting devices of the current driven type whose emission light luminance varies in response to the value of current flowing through the devices.

[Applications]

The display apparatus according to the embodiments of the present invention described above can be applied as a display apparatus of such various electric apparatus as shown in FIGS. 15 to 19. In particular, the display apparatus can be applied to display apparatus of various electronic apparatus in various fields wherein an image signal inputted to or produced in the electronic apparatus is displayed as an image, such as, for example, digital cameras, notebook type personal computers, portable terminal apparatus such as portable telephone sets and video cameras.

By using the display apparatus according to an embodiment of the present invention as display apparatus of electronic apparatus in various fields in this manner, as apparent from the foregoing description of the embodiment, the display apparatus according to the embodiment of the present invention can assure a sufficient period of time as an optimum correction time period for mobility correction and carry out mobility correction operation with certainty. Consequently, the display apparatus according to the embodiment of the present invention is advantageous in that it can display an image in high uniformity picture quality in various kinds of electronic apparatus.

It is to be noted that the display apparatus according to an embodiment of the present invention may be formed as such an apparatus of a module type having a sealed configuration. For example, the display apparatus in this instance may be a display module wherein the pixel array section 30 is adhered to an opposing portion of a transparent glass plate or the like. A color filter, a protective film, a light intercepting film or the like may be provided on the transparent opposing portion. It is to be noted that the display module may include a circuit section or a flexible printed circuit (FPC) for inputting and outputting signals and so forth from the outside to the pixel array section and vice versa.

In the following, particular examples of the electronic apparatus to which the display apparatus of the present invention is applied are described.

Figure 15:
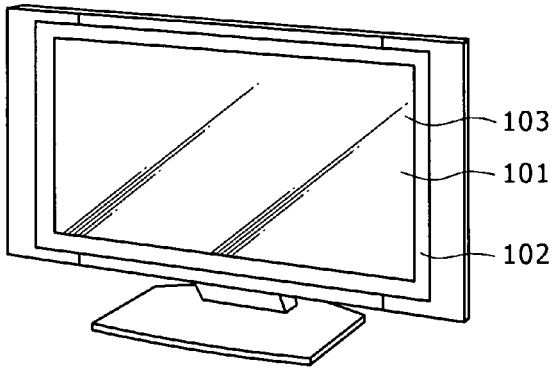
FIG. 15 is a perspective view showing an appearance of a television set to which the present invention is applied.

FIG. 15 shows a television set to which the present invention is applied. Referring to FIG. 15, the television set includes an image display screen section 101 including a front panel 102 and a filter glass plate 103 and so forth and is produced using the display apparatus of the present invention as the image display screen section 101.

Figure 16A:
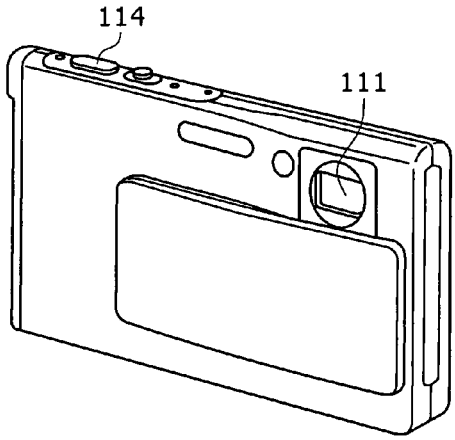
FIGS. 16A and 16B are perspective views showing appearances of a digital camera to which the embodiments of the present invention is applied as viewed from the front side and the rear side, respectively.
Figure 16B:
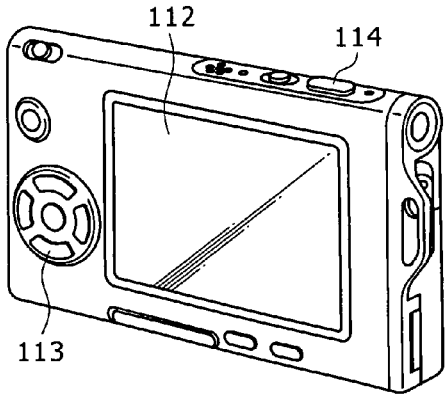

FIGS. 16A and 16B show an appearance of a digital camera to which the present invention is applied. Referring to FIGS. 16A and 16B, the digital camera shown includes a flash light emitting section 111, a display section 112, a menu switch 113, a shutter button 114 and so forth. The digital camera is produced using the display apparatus of the present invention as the display section 112.

Figure 17:
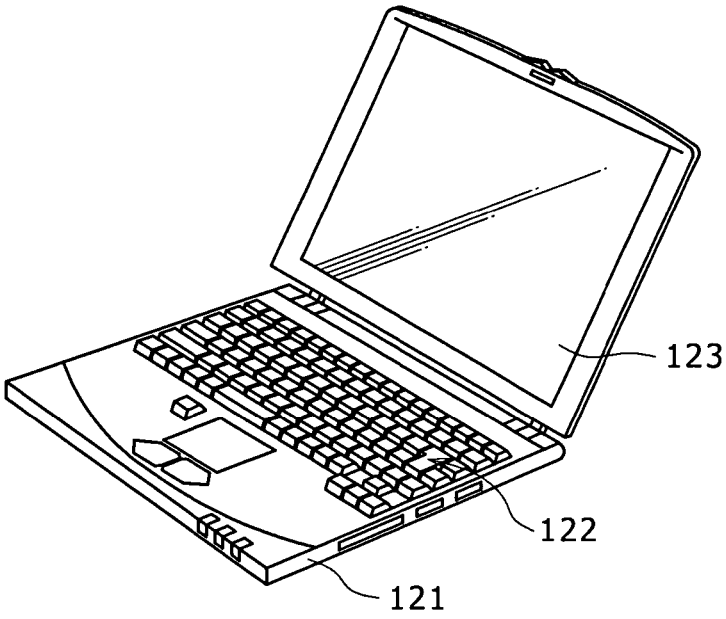
FIG. 17 is a perspective view showing an appearance of a notebook type personal computer to which the embodiments of the present invention is applied.

FIG. 17 shows a notebook type personal computer to which the present invention is applied. Referring to FIG. 17, the notebook type personal computer shown includes a body 121, a keyboard 122 for being operated in order to input characters and so forth, a display section 123 for displaying an image and so forth. The notebook type personal computer is produced using the display apparatus of the present invention as the display section 123.

Figure 18:
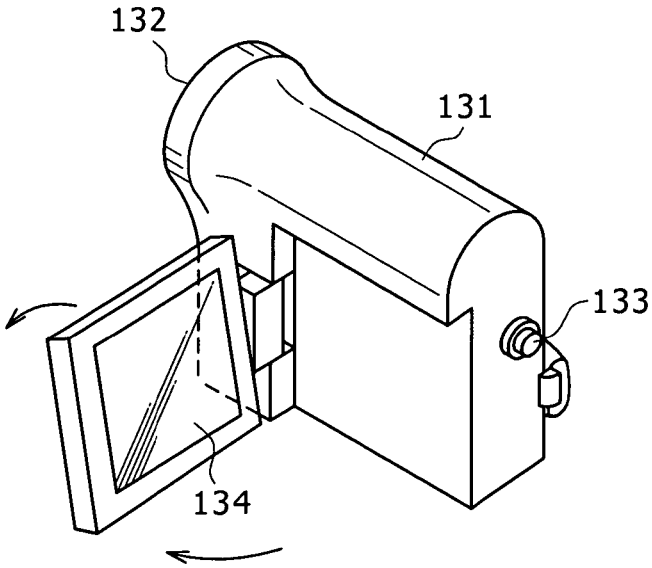
FIG. 18 is a perspective view showing an appearance of a video camera to which the embodiments of the present invention is applied.

FIG. 18 shows an appearance of a video camera to which the present invention is applied. Referring to FIG. 18, the video camera shown includes a body section 131, and a lens 132 provided on a face of the body section 131 for picking up an image of an image pickup object, a start/stop switch 133 for image pickup, a display section 134 and so forth. The video camera is produced using the display apparatus of the present invention as the display section 134.

FIGS. 19A to 19G show a portable terminal apparatus such as, for example, a portable telephone set to which the present invention is applied. Referring to FIGS. 19A to 19G, the portable terminal apparatus includes an upper side housing 141, a lower side housing 142, a connection section 143 in the form of a hinge section, a display section 144, a sub display section 145, a picture light 146, a camera 147 and so forth. The portable terminal apparatus is produced using the display apparatus of the present invention as the display section 144 or the sub display section 145.

While a preferred embodiment of the present invention has been described using specific terms, such description is for illustrative purposes only, and it is to be understood that changes and variations may be made without departing from the spirit or scope of the following claims.

What is claimed is:

1. A display apparatus, comprising:

a pixel array section including a plurality of pixels arrayed in rows and columns and each of the plurality of pixels including an electro-optical device;

a plurality of units that each comprise n≥2 pixels of the plurality of pixels and one pixel circuit, where each respective pixel circuit is shared by all of the pixels of the respective one of the plurality of units that includes the respective pixel circuit and each respective pixel circuit comprises a writing transistor for writing an image signal, a holding capacitor for holding the image signal written by said writing transistor, and a driving transistor for driving each of the electro-optical devices of the pixels of the respective one of the plurality of units that includes the respective pixel circuit, where n is an integer; and a plurality of scanning circuits configured to time-divisionally and selectively cause a driving current to flow through the electro-optical device of each pixel of a liven one of the plurality of pixels into a forwardly biased state units by:

sequentially applying a low potential to the respective cathode electrodes of the electro-optical devices of the pixels of the given one of the plurality of units, and applying, when the low potential is applied to the cathode electrode of one the electro-optical devices of the pixels of the given one of the plurality of units, a high potential to the respective cathode electrodes of the electro-optical devices of the other pixels of the given one of the plurality of units.

2. The display apparatus according to claim 1, wherein the plurality of scanning circuits and each unit of the plurality of units are configured to perform a mobility correction function of compensating for a dispersion in driving transistor mobilities, wherein the plurality of scanning circuits cause the mobility correction function to be performed for the given one of the plurality of units throughout a correction period the duration of which is set in advance and depends upon capacitance values of the given one of the plurality of units, which include a capacitance of the holding capacitor of the pixel circuit of the given one of the plurality of units and a capacitive component of the electro-optical device of each of the pixels of the given one of the plurality of units.

3. The display apparatus according to claim 1, wherein each respective pixel circuit further includes a sub capacitor connected between a source electrode of the driving transistor of the respective pixel circuit and a fixed potential.

4. The display apparatus according to claim 3, wherein the plurality of scanning circuits and each unit of the plurality of units are configured to perform a mobility correction function of compensating for a dispersion in driving transistor mobilities, wherein the plurality of scanning circuits cause the mobility correction function to be performed for a given one of the plurality of units throughout a correction period the duration of which is set in advance and depends upon capacitance values of the given one of the plurality of units, which include a capacitance of the holding capacitor of the pixel circuit of the given one of the plurality of units, a capacitance of the sub capacitor of the pixel circuit of the given one of the plurality of units, and a capacitive component of the electro-optical device of each of the pixels of the given one of the plurality of units.

5. The display apparatus according to claim 1, wherein the plurality of scanning circuits and each respective one of the plurality of units are configured to perform a threshold correction function for the pixel circuit of the respective one of the plurality of units comprising causing a threshold voltage of the driving transistor of the pixel circuit of the respective one of the plurality of units to be written into the holding capacitor of the pixel circuit of the respective one of the plurality of units prior to the image signal being written into the holding capacitor of the pixel circuit of the respective one of the plurality of units.

6. A display apparatus, comprising:

a pixel array section including a plurality of pixels arrayed in rows and columns and each of the plurality of pixels including an electro-optical device;

a plurality of units that each comprise n≥2 pixels of the plurality of pixels and one pixel circuit, where each respective pixel circuit is shared by all of the pixels of the respective one of the plurality of units that includes the respective pixel circuit and each respective pixel circuit comprises a writing transistor for writing an image signal, a holding capacitor for holding the image signal written by said writing transistor, and a driving transistor for driving each of the electro-optical devices of the pixels of the respective one of the plurality of units that includes the respective pixel circuit, where n is an integer; and a plurality of scanning circuits configured to time-divisionally and selectively place the electro-optical device of each of the plurality of pixels into a forwardly biased state by selectively controlling a cathode potential of the electro-optical device of the respective pixel, wherein:

at least one of the plurality of scanning circuits is connected to a plurality of driving lines;

the cathode of the electro-optical device of each of the plurality of pixels is connected to one of the plurality of driving lines;

the cathode of the electro-optical device of each pixel of a given one of the plurality of units is connected to a different one of the plurality of driving lines than the cathode of the electro-optical device of the other pixels of the given one of the plurality of units; and the plurality of scanning circuits are configured to sequentially place the electro-optical device of each respective pixel of a given one of the plurality of units into the forwardly biased state by selectively controlling a potential carried on the driving line connected to the cathode of the electro-optical device of the respective pixel of the given one of the plurality of units.

7. The display apparatus according to claim 6, wherein:

the plurality of units are arranged such that each respective unit of the plurality of units has n pixel positions $P_i$, where i={1, 2, . . . n}, with each of the pixels of the respective unit being disposed in a same row and in one of the pixel positions $P_i$ of the respective unit;

the plurality of driving lines are disposed such that n driving lines $L_i$, where i={1, 2, . . . n}, are provided for each row of pixels; and for each integer value of x from 1 to n, those pixels of the plurality of pixels that are disposed in corresponding pixel positions $P_{i=x}$ in a same row are connected to the driving line $L_{i=x}$ provided for that row, and the plurality of scanning circuits are configured to place the electro-optical device of each pixel that is disposed in corresponding pixel positions $P_{i=x}$ in a same row into the forwardly biased state by selectively controlling a potential carried on the driving line $L_{i=x}$ provided for that row.

8. A driving method for a display apparatus, wherein the display apparatus includes:

a pixel array section including a plurality of pixels arrayed in rows and columns and each of the plurality of pixels including an electro-optical device, and a plurality of units that each comprise n≥2 pixels of the plurality of pixels and one pixel circuit, where each respective pixel circuit is shared by all of the pixels of the respective one of the plurality of units that includes the respective pixel circuit and each respective pixel circuit comprises a writing transistor for writing an image signal, a holding capacitor for holding the image signal written by said writing transistor, and a driving transistor for driving each of the electro-optical devices of the pixels of the respective one of the plurality of units that includes the respective pixel circuit, where n is an integer;

the method comprising selectively causing a driving current to flow through placing the electro-optical device of each pixel of a given one of the plurality of units by:

sequentially applying a low potential to the respective cathode electrodes of the electro-optical devices of the pixels of the given one of the plurality of units, and applying, when the low potential is applied to the cathode electrode of one the electro-optical devices of the pixels of the given one of the plurality of units, a high potential to the respective cathode electrodes of the electro-optical devices of the other pixels of the given one of the plurality of units.

9. The driving method according to claim 8, wherein each of the plurality of units is configured to be capable of performing a mobility correction function of compensating for a dispersion in driving transistor mobilities, the method further comprising:

determining a duration of a correction period for the given one of the plurality of units based upon capacitance values of the given one of the plurality of units, which include a capacitance of the holding capacitor of the pixel circuit of the given one of the plurality of units and a capacitive component of the electro-optical device of each of the pixels of the given one of the plurality of units, and causing the mobility correction function to be performed for the given one of the plurality of units throughout the correction period.

10. The driving method according to claim 8, wherein each respective pixel circuit further includes a sub capacitor connected between a source electrode of the driving transistor of the respective pixel circuit and a fixed potential.

11. The driving method according to claim 10, wherein each of the plurality of units is configured to be capable of performing a mobility correction function of compensating for a dispersion in driving transistor mobilities, the method further comprising:

determining a duration of a correction period for the given one of the plurality of units based upon capacitance values of the given one of the plurality of units, which include a capacitance of the holding capacitor of the pixel circuit of the given one of the plurality of units, a capacitance of the sub capacitor of the pixel circuit of the given one of the plurality of units, and a capacitive component of the electro-optical device of each of the pixels of the given one of the plurality of units, and causing the mobility correction function to be performed for the given one of the plurality of units throughout the correction period.

12. The driving method according to claim 8, the method further comprising performing a threshold correction function of causing a threshold voltage of the driving transistor of the pixel circuit of a given one of the plurality of units to be written into the holding capacitor of the pixel circuit of the given one of the plurality of units prior to the image signal being written into the holding capacitor of the pixel circuit of the given one of the plurality of units.

13. A driving method for a display apparatus, wherein the display apparatus includes:

a pixel array section including a plurality of pixels arrayed in rows and columns and each of the plurality of pixels including an electro-optical device, and a plurality of units that each comprise n≥2 pixels of the plurality of pixels and one pixel circuit, where each respective pixel circuit is shared by all of the pixels of the respective one of the plurality of units that includes the respective pixel circuit and each respective pixel circuit comprises a writing transistor for writing an image signal, a holding capacitor for holding the image signal written by said writing transistor, and a driving transistor for driving each of the electro-optical devices of the pixels of the respective one of the plurality of units that includes the respective pixel circuit, where n is an integer;

the method comprising selectively placing the electro-optical device of each of the plurality of pixels into a forwardly biased state by selectively controlling a cathode potential of the electro-optical device of the respective pixel, wherein at least one of the plurality of scanning circuits is connected to a plurality of driving lines, the cathode of the electro-optical device of each of the plurality of pixels is connected to one of the plurality of driving lines, and the cathode of the electro-optical device of each pixel of a given one of the plurality of units is connected to a different one of the plurality of driving lines than the cathode of the electro-optical device of the other pixels of the given one of the plurality of units, and wherein the method further comprises:

sequentially placing the electro-optical device of each respective pixel of a given one of the plurality of units into the forwardly biased state by selectively controlling a potential carried on the driving line connected to the cathode of the electro-optical device of the respective pixel of the given one of the plurality of units.

14. The driving method according to claim 13, wherein:

the plurality of units are arranged such that each respective unit of the plurality of units has n pixel positions $P_i$, where $i=\{1, 2, \ldots n\}$, with each of the pixels of the respective unit being disposed in a same row and in one of the pixel positions $P_i$ of the respective unit;

the plurality of driving lines are disposed such that n driving lines $L_i$, where $i=\{1, 2, \ldots n\}$, are provided for each row of pixels; and for each integer value of x from 1 to n, those pixels of the plurality of pixels that are disposed in corresponding pixel positions $P_{i=x}$ in a same row are connected to the driving line $L_{i=x}$ provided for that row, and the plurality of scanning circuits are configured to place the electro-optical device of each pixel that is disposed in corresponding pixel positions $P_{i=x}$ in a same row into the forwardly biased state by selectively controlling a potential carried on the driving line $L_{i=x}$ provided for that row.

* * * * *